US006129089A

United States Patent [19]

Yuhara

[11] Patent Number: 6,129,089

[45] Date of Patent: Oct. 10, 2000

[54] COSMETIC CASE WITH HINGED REFILL CONTAINER PART

[75] Inventor: Yukitomo Yuhara, Chiba, Japan

[73] Assignee: Yoshida Industry Co. Ltd., Tokyo, Japan

[21] Appl. No.: 09/429,469

[22] Filed: Oct. 28, 1999

[30] Foreign Application Priority Data

| | | | |
|---|---|---|---|
| Nov. 5, 1998 | [JP] | Japan | 10-315009 |
| Nov. 10, 1998 | [JP] | Japan | 10-319599 |
| Dec. 7, 1998 | [JP] | Japan | 10-346988 |

[51] Int. Cl.[7] ..... A45D 40/22

[52] U.S. Cl. ..... 132/300; 132/314; 206/581

[58] Field of Search ..... 206/581, 823; 132/293–307, 314, 315

[56] References Cited

U.S. PATENT DOCUMENTS

| | | | |
|---|---|---|---|
| 2,078,096 | 4/1937 | Parkin . | |
| 5,199,451 | 4/1993 | Montol | 132/314 X |
| 5,320,116 | 6/1994 | Achermonn | 132/293 |
| 5,353,818 | 10/1994 | Suzuki et al. . | |
| 5,875,795 | 3/1999 | Bouix | 132/293 |

FOREIGN PATENT DOCUMENTS

| | | |
|---|---|---|
| 58-40003 | 3/1983 | Japan . |
| 63-28407 | 2/1988 | Japan . |
| 3-123411 | 12/1991 | Japan . |
| 8-347 | 1/1996 | Japan . |
| 8-348 | 1/1996 | Japan . |
| 8-38242 | 2/1996 | Japan . |
| 8-196337 | 8/1996 | Japan . |
| 9-37838 | 2/1997 | Japan . |
| 9-47319 | 2/1997 | Japan . |
| 9-65920 | 3/1997 | Japan . |
| 9-98828 | 4/1997 | Japan . |
| 9-98829 | 4/1997 | Japan . |
| 9-140441 | 6/1997 | Japan . |
| 10-192043 | 7/1998 | Japan . |
| 10-192044 | 7/1998 | Japan . |

*Primary Examiner*—Bryon P. Gehman
*Attorney, Agent, or Firm*—Harness, Dickey & Pierce, P.L.C.

[57] ABSTRACT

A cosmetic case comprised of a main case into which a removable sealed refill container can be installed. The main case is comprised of a main hinge on which a main case cover pivots, a latch able to hold the main case cover closed, a perimeter wall located between the main hinge and latch, and a cutout space which is provided to enclose the hinge of the internally installed refill container. The cutout space is formed within the inner surface of the perimeter wall but does not extend to the outer surface, thereby hiding the refill container hinge from an external view of the cosmetic case. The refill container includes a hinged cover and latch mechanism to hold the cover closed against the refill container body. A single action release mechanism is provided to simultaneously or sequentially open the main case latch and refill container latch.

8 Claims, 24 Drawing Sheets

COSMETIC CASE WITH HINGED REFILL CONTAINER PART

BACKGROUND OF THE INVENTION

1. Field of the Invention

The invention relates to a cosmetic case of the type incorporating a replaceable internal refill container, and a refill container cover part as means of sealing the cosmetic material contained in the cosmetic case.

2. Description of the Related Art

A cosmetic case similar to the type presented in this application has been put forth by Japanese unexamined patent publication No. 10-192044. The aforesaid Japanese patent publication describes a cosmetic case structure in which a mirror is attached to the underside of a rotatably hinged main case cover, a main latch used to maintain the main case cover in a closed position against a main case, and front and rear compartments formed by means of a divider wall located at the approximate center of the main case. The main case thus provides a rear compartment that may contain a "puff" or other like cosmetic applicator tool, and a front compartment that may include a tray container as means of holding a cosmetic substance within the main case. A container cover is rotatably attached to hinge pins formed in a depression located at the approximate center of the aforesaid divider wall. A container latch is installed to the aforesaid container cover as means of atmospherically sealing the container cover against the container, and thus sealing the cosmetic substance in the aforesaid tray container.

The aforesaid hinge pins are transversely aligned at the rear of the front compartment so as to allow the inner cover to rotate upward on a fore-aft axis, thus allowing the outer and inner covers to rotate in an upward and rearward direction when the main latch is released.

This structure, in which the container cover overlaps the inner surface of the main case cover when both covers are open, not only limits the amount of mirror surface exposed on the underside of the main case cover, but also prevents the container cover from opening to a desirably wide angle that can provide easier access to the cosmetic material.

Moreover, as most cosmetic materials evaporate relatively quickly, it is desirable, at the time of assembly, to seal the cosmetic case as soon as possible after the tray container is filled with the cosmetic material. As a result of the main case and container tray being separate components, the assembly process involves a sequence in which the tray is filled with the cosmetic material and placed in the lower case after which the inner cover is installed and closed over the tray. A faster assembly process than this is desired because the cosmetic material is exposed to the atmosphere for a relatively long period of time. One method utilized to compensate for this problem is to install a temporary cover over the cosmetic tray during the assembly process. This method, however, increases the assembly cost and complicates the assembly procedure.

There is an additional problem in that the aforesaid main case cover and refill container cover latches must be released separately, and the main case cover and refill container cover opened separately, to provide access to the cosmetic material. This two-stage process makes it somewhat awkward and inconvenient to use the cosmetic case.

SUMMARY OF THE INVENTION

The invention puts forth a cosmetic case structure incorporating a main case cover and refill container cover that do not mutually overlap when opened, an improved latch mechanism that provides more convenient access to the internal area of the case, and a structure which provides for a more efficient and less costly cosmetic filling and case assembly process.

The invention is comprised of a main case part containing an inner compartment defined by a perimeter wall, a main hinge part installed at the rear of the main case, a main case cover capable of exposing or closing the inner compartments, a main latch forming a releasable connection between the front of the main case and main case cover, and a sealable refill container removably installed within the inner compartment.

The sealable refill container includes a container body part into which a cosmetic material is placed, a container hinge part installed on one end of the container body, a container cover part rotatably attached to the container hinge part as means of exposing or sealing the contents of the container body, and a refill container latch part formed on the container cover and container body at a location opposite to the container hinge part.

A cutout space is formed, at a location on the perimeter wall within a region extending from the main hinge and main latch, as means of enclosing the container hinge part, the cutout space being open at the internal surface of the perimeter wall facing the internal compartment, but not extending to the external surface of the perimeter wall.

The internal space defined within the main case may consist of a single compartment into which the sealable refill container is removably installed. The cutout space may be located at a point on the perimeter of the internal space that does not interfere with the main hinge or main latch.

Moreover, the space defined within the main case may also include a divider wall that separates the internal space into front and rear compartments. The refill container may be removably installed within the rear compartment, and the cutout space may be formed within an inward facing surface of the perimeter wall or divider wall in a region extending from the front to the rear of the walls defining the rear compartment, providing that the location of the cutout space does not interfere with operation of the main hinge.

While, the space defined within the main case may also include a divider wall that separates the internal space into front and rear compartments. The refill container may be removably installed within the front compartment, and the cutout space may be formed within an inward facing surface of the perimeter wall or divider wall in a region extending from the front to the rear of the walls defining the front compartment, providing that the location of the cutout space does not interfere with operation of the main latch.

A single action release part is provided at the front of the main case as means of sequentially releasing the main latch and refill container latch.

The single action release part is rotatably supported at its center section, incorporates a push piece exposed to the external area of the main case, and a push-up part at the extremity opposite to the push piece, said push-up part extending rearward past the center section, thus forming a structure whereby manually depressing the push piece will result in the push-up part pivoting in a manner as to forcibly push-up both the main case cover and refill container cover through the push-up fingers.

The push-up part incorporates a main cover push-up part and a separate container cover push-up part, the dimension between the container cover push-up part and the container cover being larger then the dimension between the main cover push-up part and main cover, thus providing means of pushing open the main case cover before the container cover.

Moreover, the cosmetic case may be formed as a structure in which the main case cover is located above the sealable refill container cover, or as a structure in which a pivoting internal frame is attached to the main hinge and located within the internal case space, said sealable refill container being removably installed within the pivoting internal frame, and in which a space is formed above the container cover or beneath the pivoting internal frame within the cosmetic case for storage of a cosmetic applicator puff or other like tool.

The hinge of the sealed refill container inserts into the cutout space formed within the perimeter wall or divider wall in an area extending between the main hinge and main latch in a manner as not to interfere with the hinge and latch. This structure provides for a mechanism whereby the refill container cover is prevented from covering the main case cover when both covers are opened, thus allowing the complete mirror surface (installed to the inner surface of the main case cover) to be exposed, and also allowing the container cover to open to a wider angle to provide for easier and more convenient access to the cosmetic material.

The cutout space allows the height of the container hinge protruding upward from the perimeter wall to be reduced, thus allowing the thickness of the cosmetic case to be reduced.

The cutout space is formed only into an inner surface of the perimeter wall and does not extend to the outer surface of the wall, thus concealing the refill container hinge when the cosmetic case is externally viewed, and thus providing for an improved appearance.

Moreover, the invention provides for a sealable cosmetic refill container to which a container cover part is attached, the refill container being removably installed to the internal case space, thus allowing for the refill container to be quickly sealed after the cosmetic material has been inserted therein, and thus preventing evaporation of the cosmetic material in storage condition. This structure also provides for an improved and simplified assembly process in which the refill container can simply be inserted into the main case in a single motion. Moreover, because the covered refill container can be transported as a separate item without fear of the cosmetic material evaporating, the need to install a temporary cover, as part of the manufacturing operation, is eliminated. These structures have the effect of reducing the cost of manufacturing the cosmetic case.

Furthermore, the single action release part provides means of releasing both the main latch and refill container latch, thus providing a more convenient means of opening and accessing the contents of the cosmetic case.

Moreover, the invention provides for a structure in which the push-up part is divided into a main case cover push-up part and a separate container cover push-up part. While the push-up part may open both the main case cover and container cover in an approximate simultaneous action, this structure allows for partial movement of the push-up part to open the main case cover latch only when it is desired only to view the mirror, and for full movement of the push-up part to open both the main case cover latch and container cover latch when access to the cosmetic material is desired.

Furthermore, the invention provides for a structure in which a sealable refill container is removably installed to a pivoting internal frame part located within the main case, and a space defined by the main case perimeter wall and main case cover. The same space may also be defined over the container cover within the cosmetic case. The space being located above the refill container or beneath the pivoting internal frame part as means of providing storage space for a cosmetic applicator tool.

DESCRIPTION OF THE PREFERRED EMBODIMENT

Figure 1:
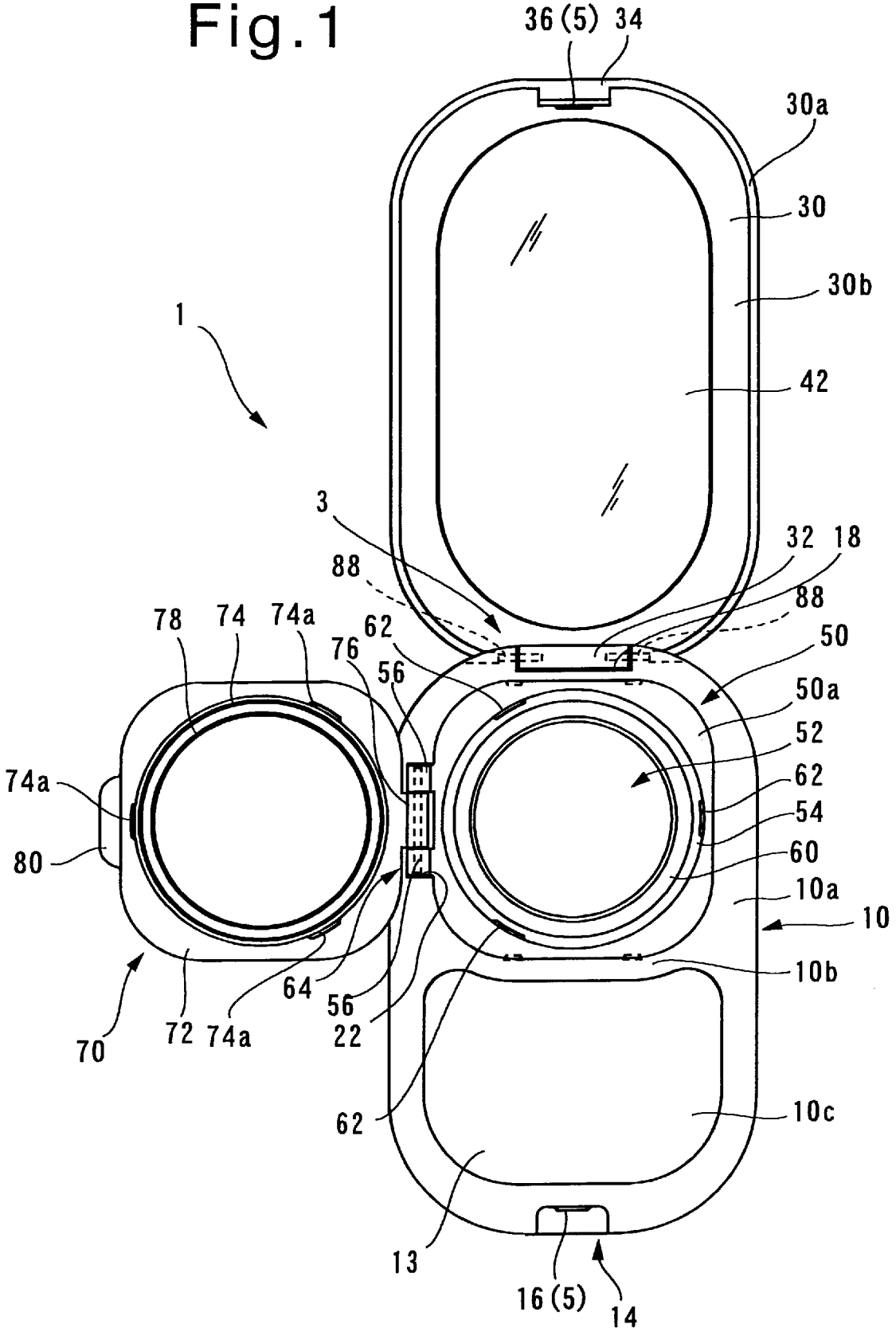
FIG. 1 is a plan view of the first embodiment of the invention with the main case cover and refill container cover open.
Figure 2:
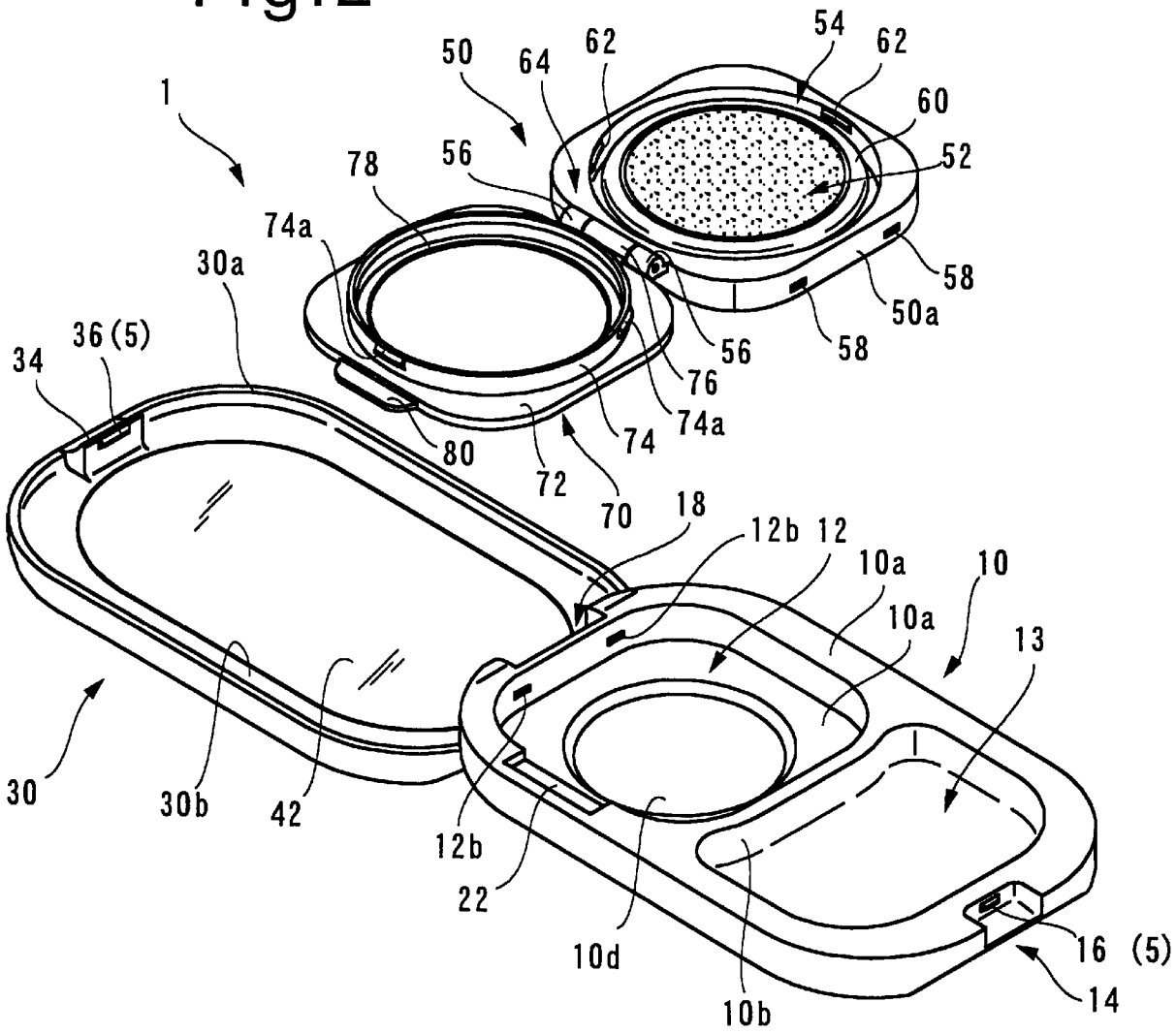
FIG. 2 is an oblique exploded view of the main components of the first embodiment.
Figure 3:
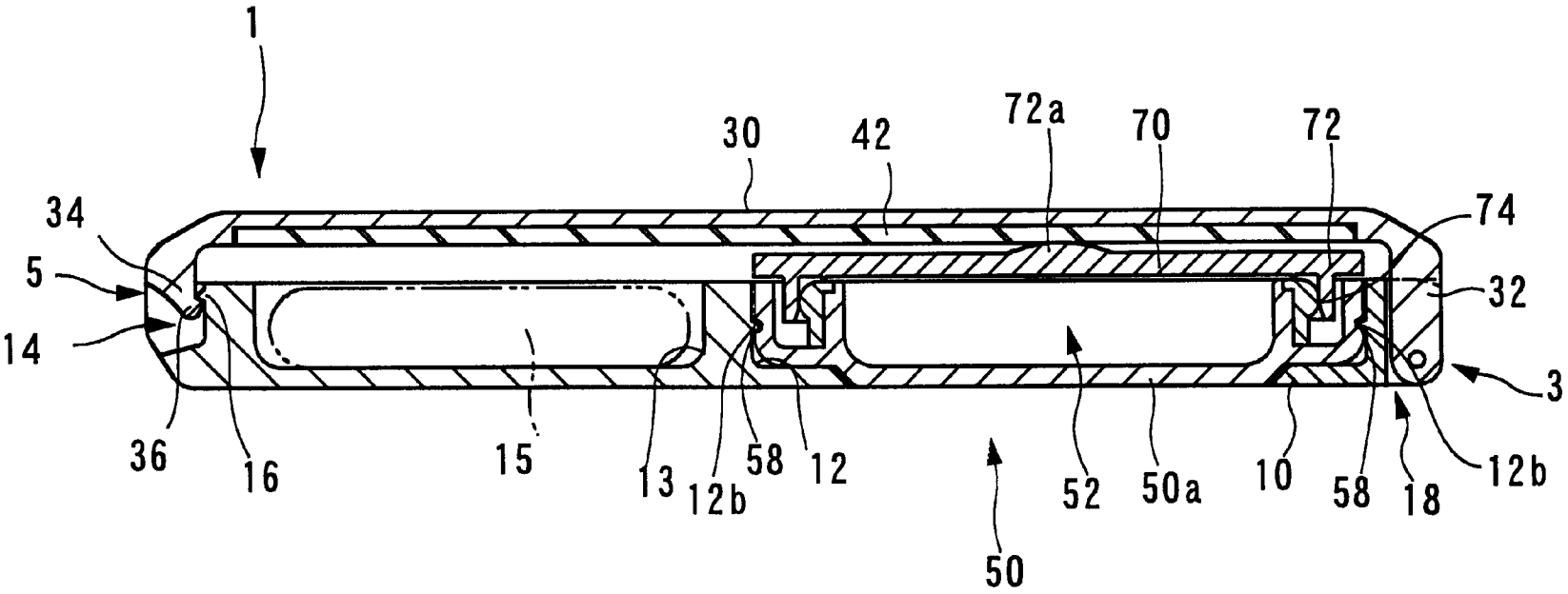
FIG. 3 is a lateral cross sectional view of the first embodiment.
Figure 4:
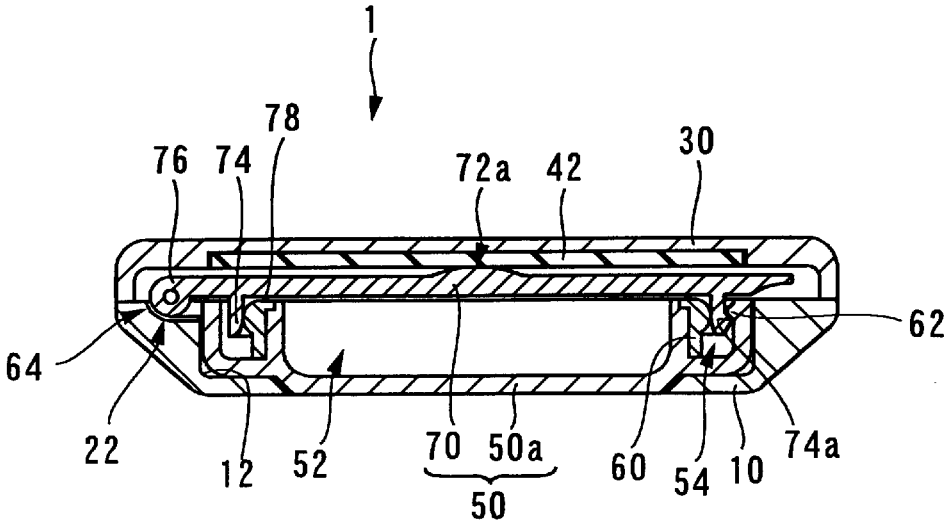
FIG. 4 is a front cross sectional view of the first embodiment.
Figure 5:
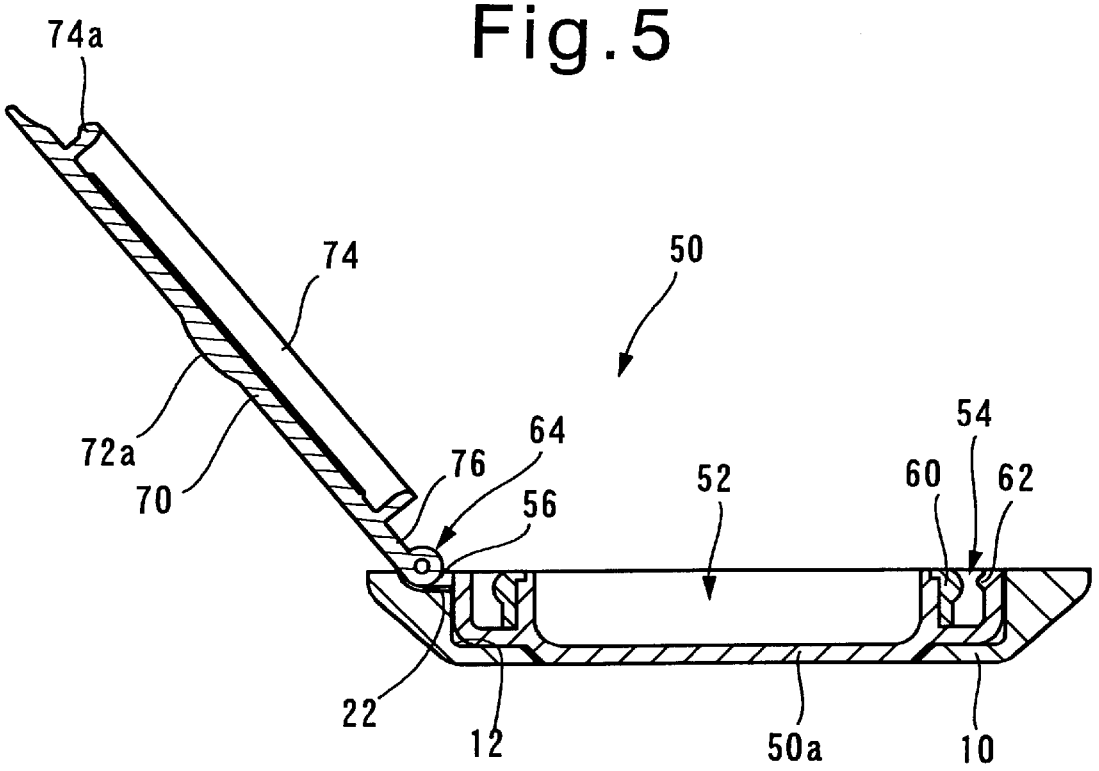
FIG. 5 is a front cross sectional view of the first embodiment with the refill container cover open.

The following will discuss embodiments of the invention with reference to the attached figures.

FIGS. 1 through 5 show the first embodiment of the invention wherein main case 10, being of relatively long rectangular shape with rounded corners, incorporates removable refill container 50 which in turn incorporates container tray 52, and mirror 42 installed to the underside of main case cover 30.

The inner area of main case 10 is defined by perimeter wall 10*a,* divider wall 10*b* running between the two longer sides of perimeter wall 10*a,* and bottom wall 10*c,* said walls defining compartments 12 and 13. Refill container 50 is removably installed within compartment 12 at the rear of main case 10, and a puff or other like cosmetic applicator tool may be placed in compartment 13. Tabs 12*b* are formed on an inner wall of compartment 12 as means of securing refill container 50 within compartment 12. Orifice 10*d* is provided at the bottom of compartment 12 as means of allowing the user to insert a finger through the bottom of main case 10 to forcibly push up and remove refill container 50.

Front latch cutout 14 is provided within the outer facing forward wall of main case 10, and joint lip 16 is formed on the inward facing surface of latch cutout 14. Hinge cutout 18 is formed in the center of the rear wall of main case 10 as means of providing for the attachment of outer hinge 3 within the rear wall of main case 10.

Cutout space 22 is formed within perimeter wall 10*a* at the left side of compartment 12 and faces inward so as to form a continuation of compartment 12 within wall 10*a*.

Main case cover 30 incorporates perimeter wall 30*a* which is formed to the same shape as perimeter wall 10*a* of main case 10. Mirror 42 is installed to underside 30*b* of main case cover 30, and main case hinge boss 32 is formed on the rear outer side of main cover 30 so as to insert within and rotatably connect to cutout 18 by means of hinge pin 88. Main case latch 34 is provided on the front surface of main case cover 30 so as to movably insert to front latch cutout 14, and latch lip 36 is provided on main case latch 34 as means of forming a releasable connection with joint lip 16.

The perimeter of refill container 50 is formed so as to conform to the shape of compartment 12. Refill container 50 is comprised of refill container body 50*a* into which container tray 52 is integrally formed, container cover 70 pivotably installed over container tray 52 so as to atmospherically seal container tray 52 when closed, and hinge boss 56 to which container hinge 64 is inserted as means of allowing container cover 70 to freely pivot against and away from refill container body 50*a*. Container tray 52 is a circular hollowed out void formed within refill container body 50*a*. Groove 54 is formed adjacently and continuously around the upper perimeter of container tray 52 as means of securing a ring-shaped sealing part. Container fingers 62 are formed at regular intervals on the outer wall of groove 54, one of container fingers 62 being located opposite and across from hinge boss 56. Sealing ring 60 is installed within groove 54 and extends radially inward against the periphery of container tray 52. Container notches 58 are installed to the outer periphery of refill container body 50*a,* and removably connect to tabs 12*b* on the inner wall of main case 10 as means of securely maintaining refill container 50 within compartment 12. A pair of refill container hinge bosses 56 is formed at the upper edge of the outer perimeter of refill container body 50*a*. Hinge boss 76 is pivotably installed between container hinge bosses 56, thus establishing container hinge 64 which allows container cover 70 to be rotatably connected to refill container body 50*a*.

Container cover 70 is primarily comprised of cover plate 72, circular lip 74 which protrudes upward from the inner surface of cover plate 72, and refill cover hinge boss 76 which is inserted between refill container hinge bosses 56 to form container hinge 64. Bumper 72*a* is formed on the upper side of cover plate 72 and is pressed against by mirror 42 when main case cover 30 is closed. Circular lip 74 is formed on the underside of cover plate 72 and located so as to enter groove 54 in refill container body 50*a* when container cover 70 is closed. Pressure ridge 78 is formed on the inner surface of cover plate 72 and extends circumferentially from the underside of cover plate 72, at a position radially inward from circular lip 74, as means of pressurizing sealing ring 60 when container cover 70 is closed. Hinge boss 76, formed on one edge of cover plate 72, inserts between refill container hinge bosses 56 to form container hinge 64. Manual opening lip 80 is formed on the edge of cover plate located opposite hinge boss 76. Cover fingers 74*a* are formed on the outer periphery of circular lip 74 at locations where they are able to connect with container fingers 62 when container cover 70 is closed.

Main case hinge boss 32 resides within hinge cutout 18 on main case cover 30, and hinge pin 88 is inserted through cutout 18 and hinge boss 32 to form outer hinge 3.

Container notches 58 receive tabs 12*b* within compartment 12 as means of securing refill container body 50*a* within main case 10. When refill container body 50*a* is inserted into main case 10, container hinge 64 locates within cutout space 22, thus allowing container cover 70 to freely rotate to opened and closed positions. Container cover 70 is held in a closed position by the respective joining of cover fingers 74*a* and container fingers 62. When container cover 70 is closed, the inner periphery of circular lip 74 presses against the outer periphery of circular seal 60 in groove 54, and pressure ridge 78 simultaneously presses against the upper surface of seal 60, thus creating a tight atmospheric seal between container cover 70 and container tray 52. Main case cover 30 can be closed against main case 10 through the connection formed between joint lip 16 (on main case 10) and latch lip 36 (on main case cover 30). Main case cover 30, when in a closed position, provides additional closing pressure against container cover 70 by means of mirror 42 behind held against bumper 72*a*.

The following procedure is employed to access the cosmetic material contained in the closed cosmetic case. First, main latch 5 is released allowing main case cover 30 to rotate upward and backward on outer hinge 3. Manual opening lip 80 is then grasped and pulled upward to release the connection between cover fingers 74*a* and container fingers 62, thus allowing container cover 70 to be rotated upward and to the left away from main case 10 to expose the cosmetic material held in refill container body 50*a*.

Cutout space 22 is formed within outer wall 10*a* of compartment 12 as a continuation of the space within compartment 12, thus allowing container hinge 64 to locate therein and be enclosed within perimeter wall 10*a* of main case 10. As a result of inner hinge 64 residing within cutout space 22, the part of container hinge 64, which would otherwise extend above perimeter wall 10*a*, can be significantly reduced, thus allowing the overall thickness of the cosmetic case to be reduced to enhance its portability.

As cutout space 22 does not completely pass through perimeter wall 10*a*, said space cannot be seen when main case 10 is externally viewed. In other words, when main case cover 30 is closed, cutout space 22 and container hinge 64 are completely hidden from view, thus providing a design element that improves the external appearance of the cosmetic case.

Cutout space 22 is located so that outer hinge 3 and container hinge 64 can be positioned in dissimilar directions, thus allowing main case cover 30 and container cover 70 to open in different and non-overlapping directions. The result is that the view of mirror 42 is not blocked by container cover 70, and that container cover 70 is able to open widely to expose container tray 52, thus forming a structure that provides for more convenient use of the cosmetic case.

As container tray 52 can be sealed by means of closing container cover 70, refill container 50 can be sealed immediately after being filled with cosmetic material, thus preventing the cosmetic material from evaporating before refill container 50 is inserted into main case 10. Moreover, refill cover 70 makes it possible to store cosmetic material within refill container 50 for extended periods of time without container 50 being installed within main case 10, thus providing for more efficient filling of container 50 with cosmetic material. Furthermore, the use of container cover 70 can reduce assembly costs by eliminating the need to place a temporary cover over the cosmetic material in order to prevent it from evaporating. The structures described above provide for significant cost reductions in the manufacture of cosmetic cases of this type.

Figure 6:
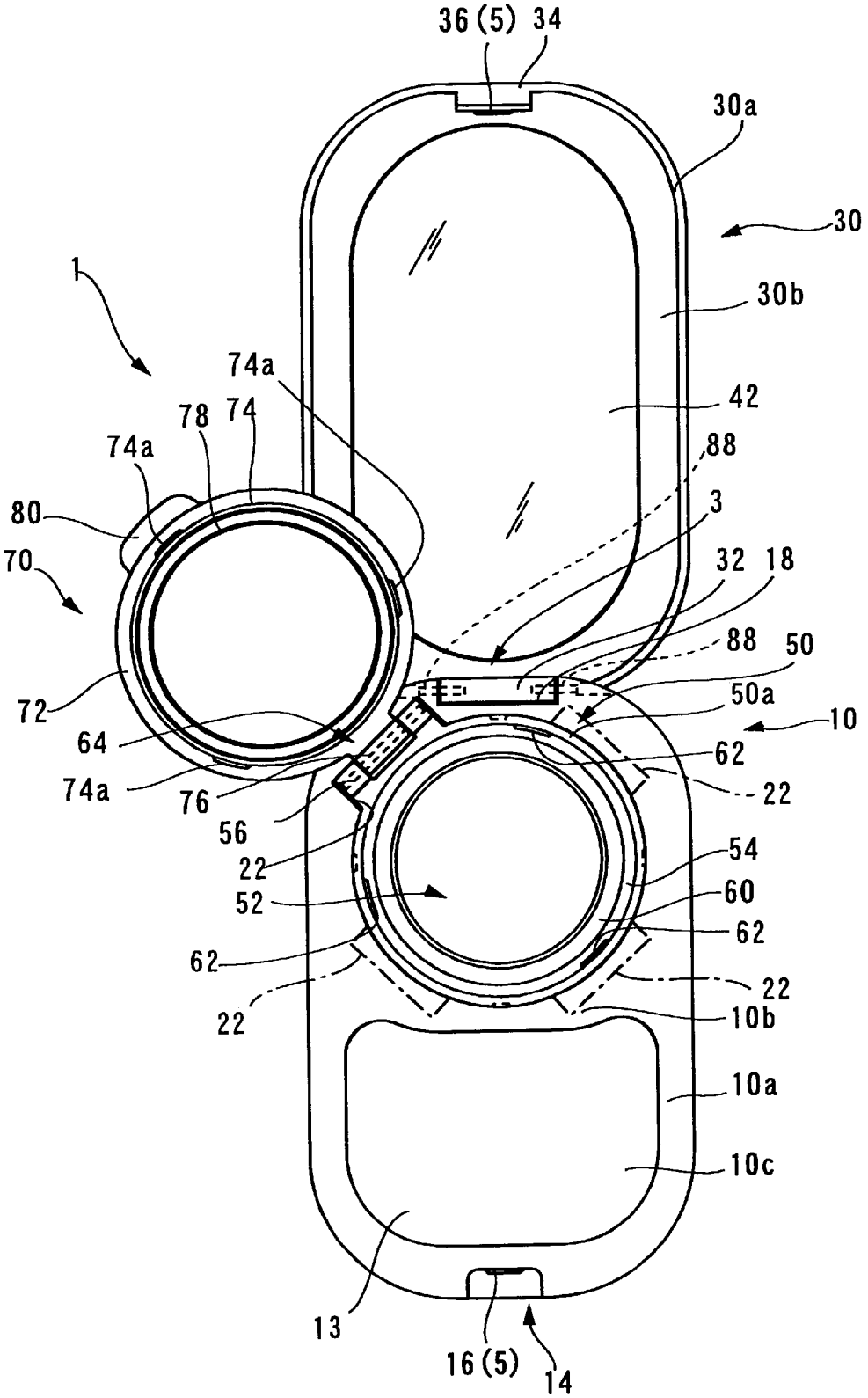
FIG. 6 is a plan view showing a modified version of the first embodiment with the main case cover and refill container cover open.
Figure 7:
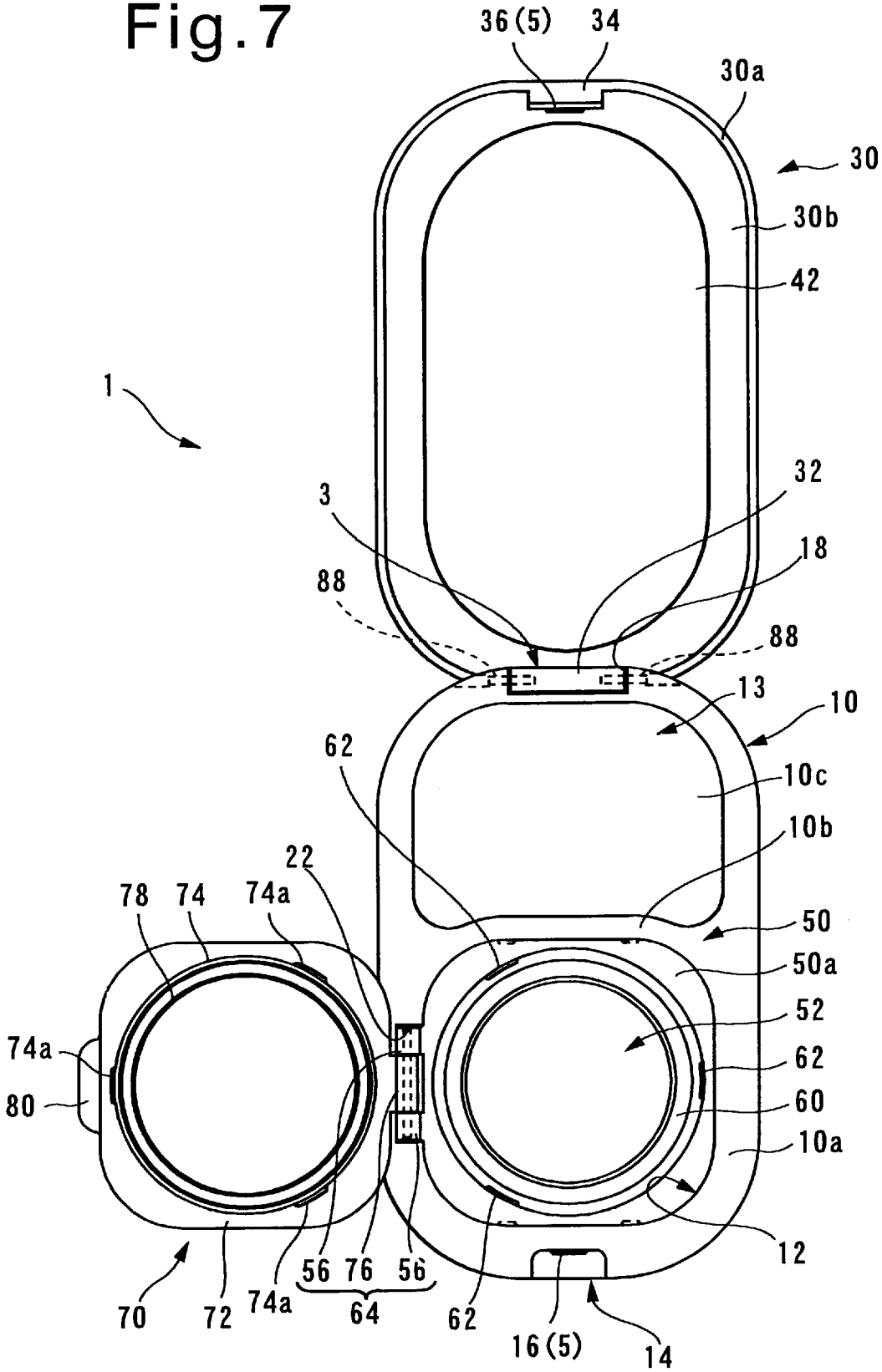
FIG. 7 is a plan view of a second embodiment of the invention with the main case cover and refill container cover in an open position.
Figure 8:
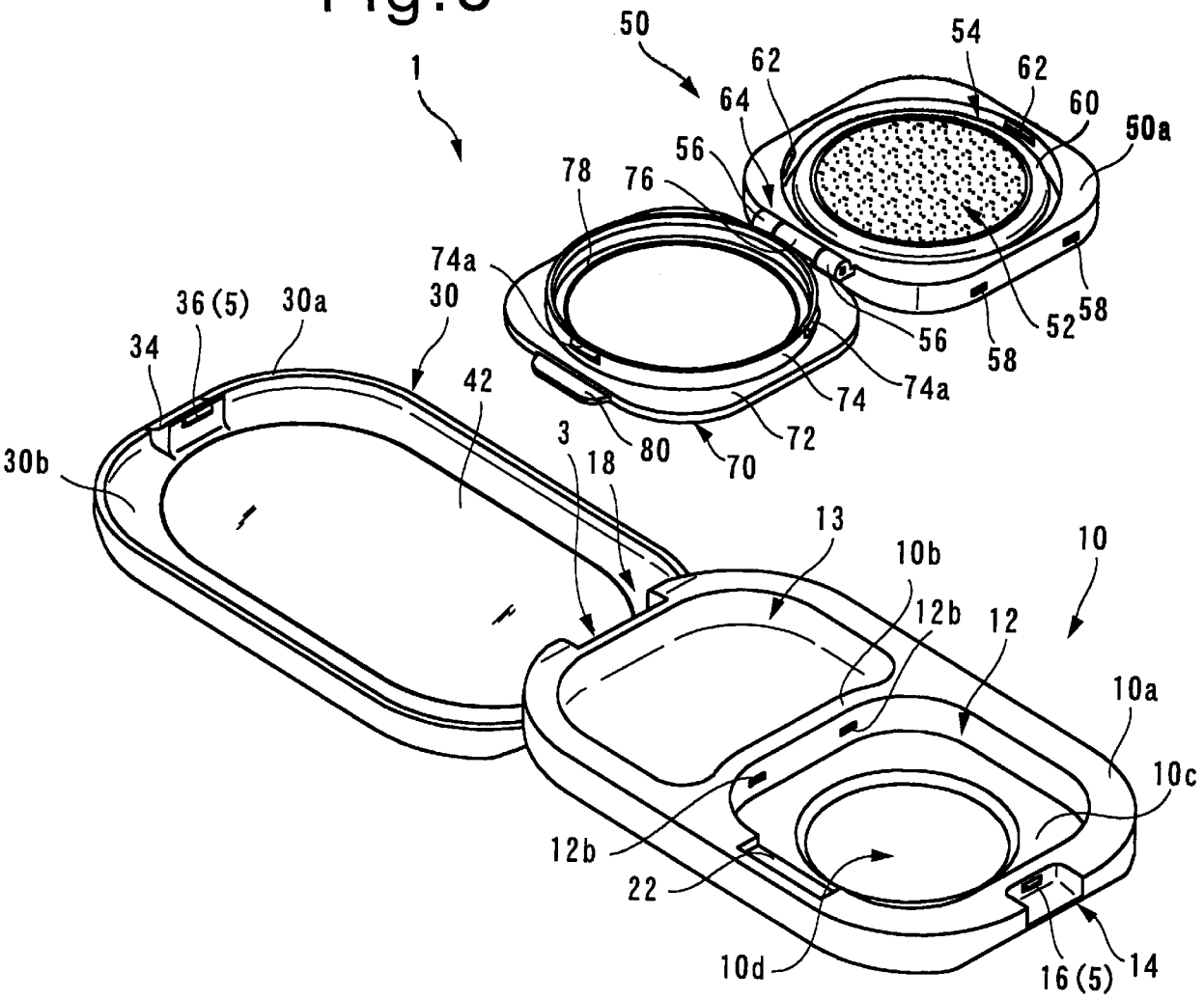
FIG. 8 is an oblique exploded view of the second embodiment.
Figure 9:
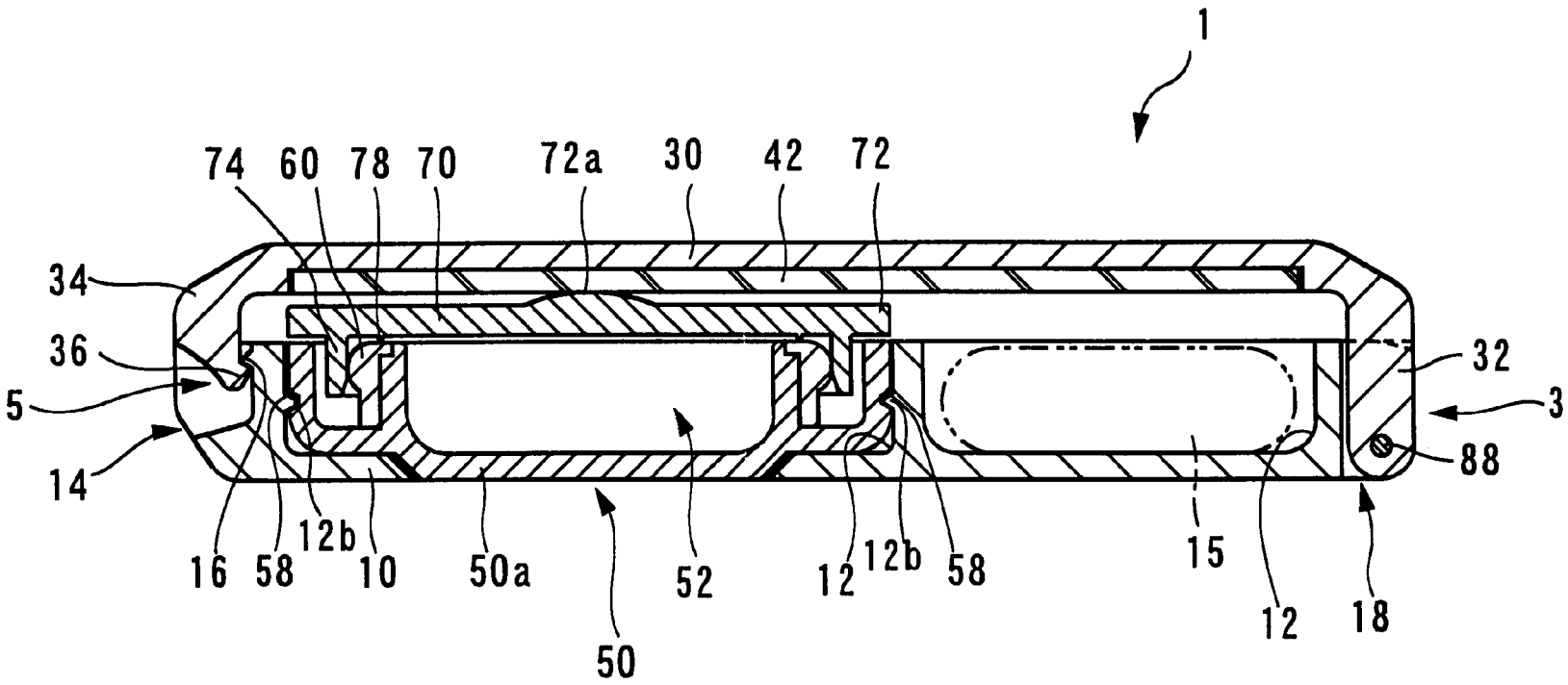
FIG. 9 is a lateral cross sectional view of the second embodiment.
Figure 10:
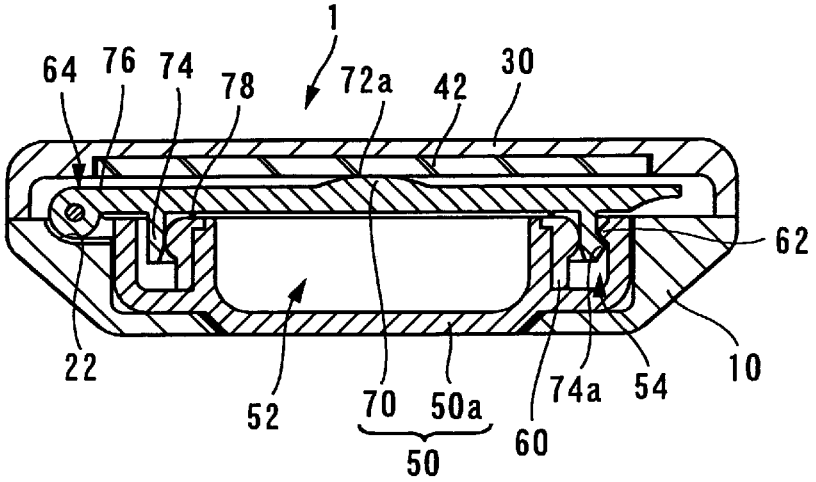
FIG. 10 is a front cross sectional view of the second embodiment.
Figure 11:
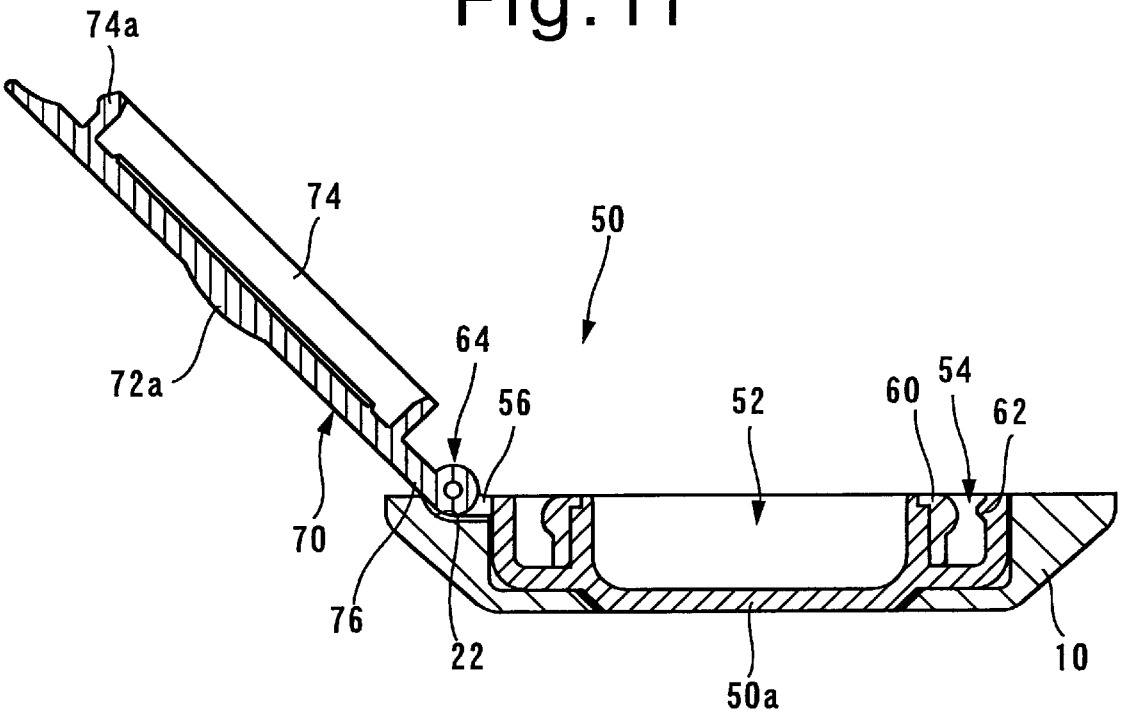
FIG. 11 is a front cross sectional view of the second embodiment with the refill container cover in an open position.

As shown in FIG. 6, cutout space 22 may be located at various positions around compartment 13, positions which all prevent container cover 70 from blocking the view of mirror 42 when container cover 70 is open. In terms of practical design, it is desirable to locate cutout space 22 at a point in a region extending from divider wall 10*b* and outer hinge 3.

FIGS. 7 through 11 show a second embodiment of the invention in which storage compartment 13, which can be used to store cosmetic applicator tool 15, is located to the rear of the cosmetic case, and refill container 50 is located in compartment 12 to the front of the case.

Figure 12:
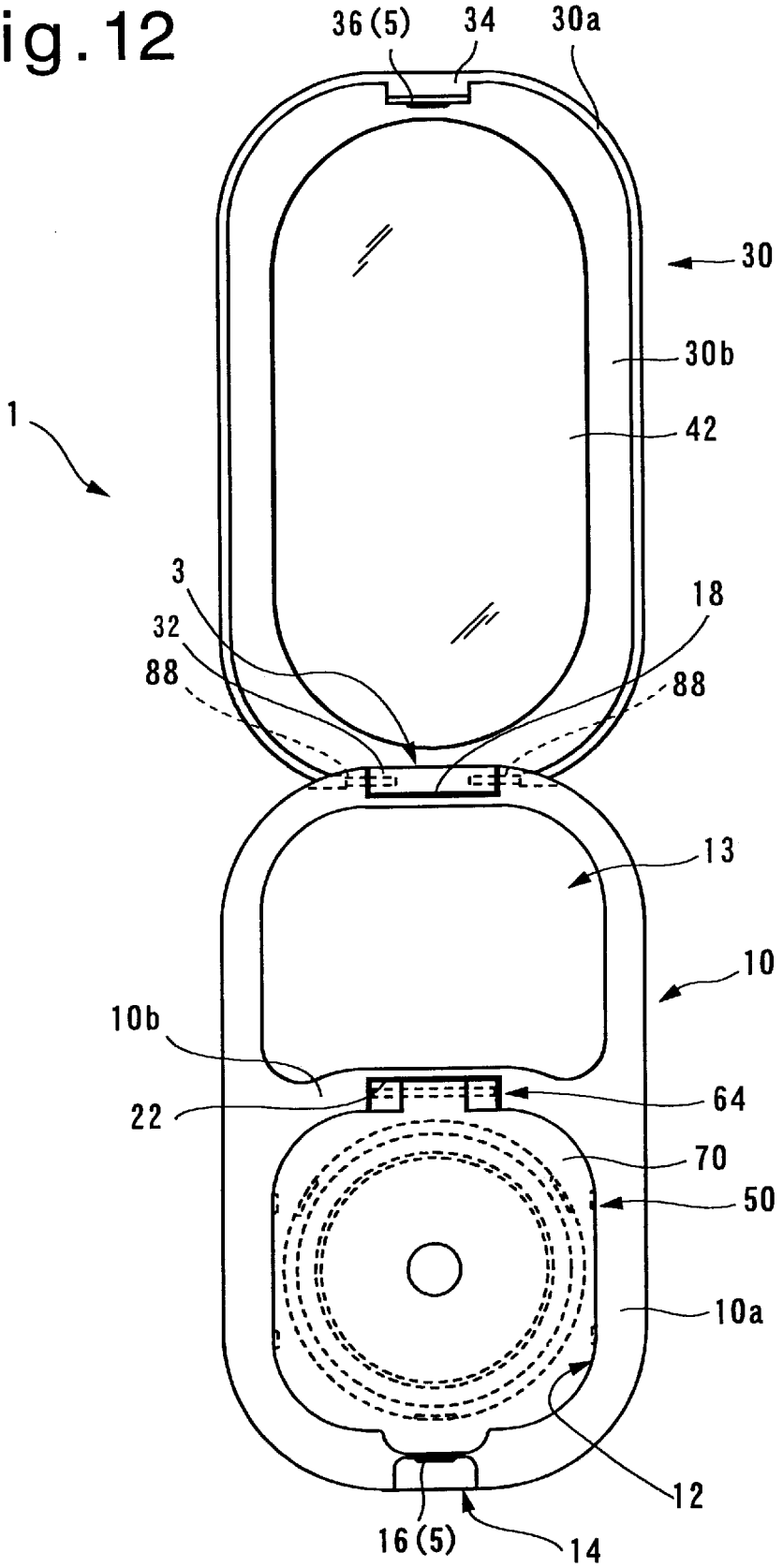
FIG. 12 is a plan view of a first modified version of the second embodiment.
Figure 13:
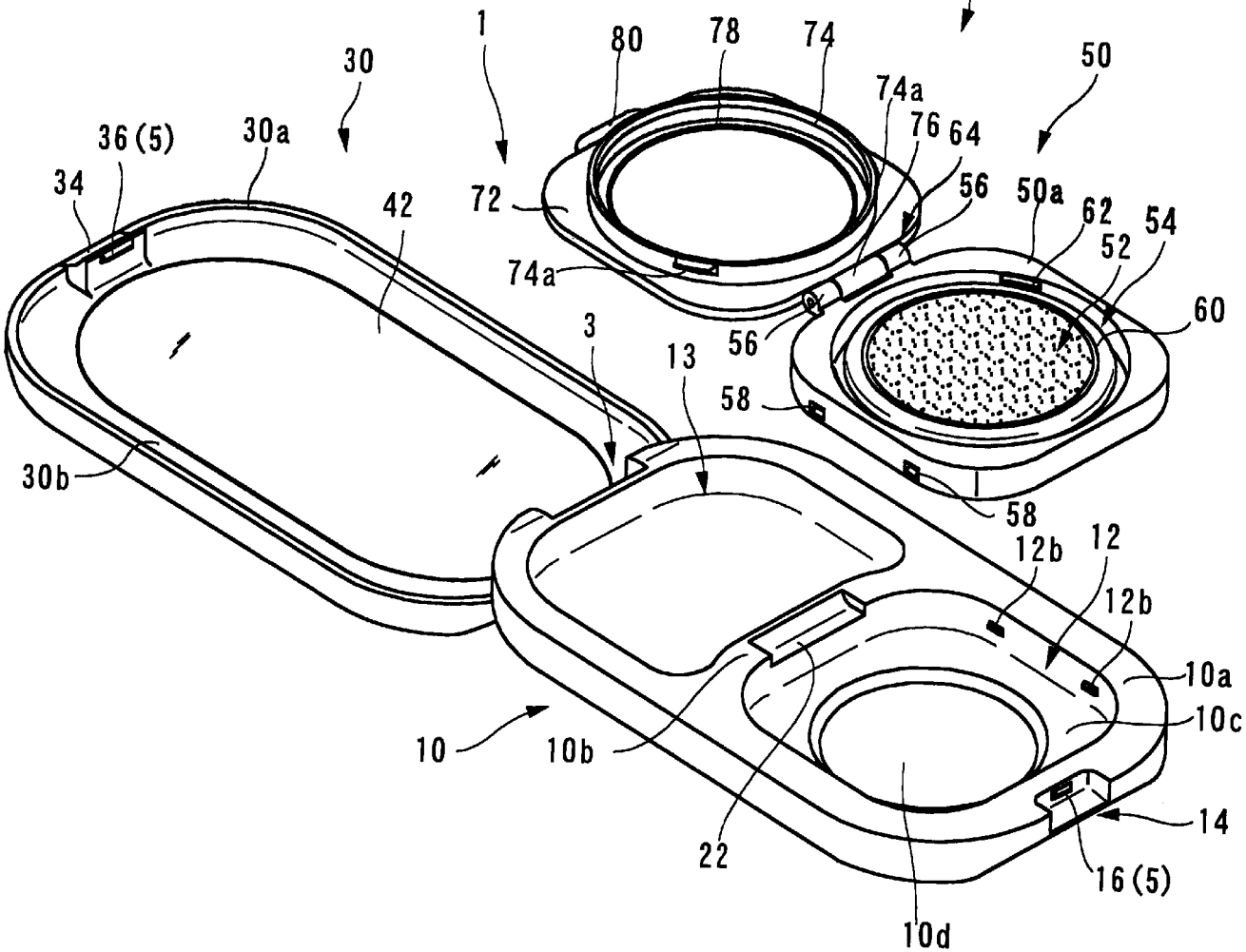
FIG. 13 is an exploded oblique view of the first modified version of the second embodiment.
Figure 14:
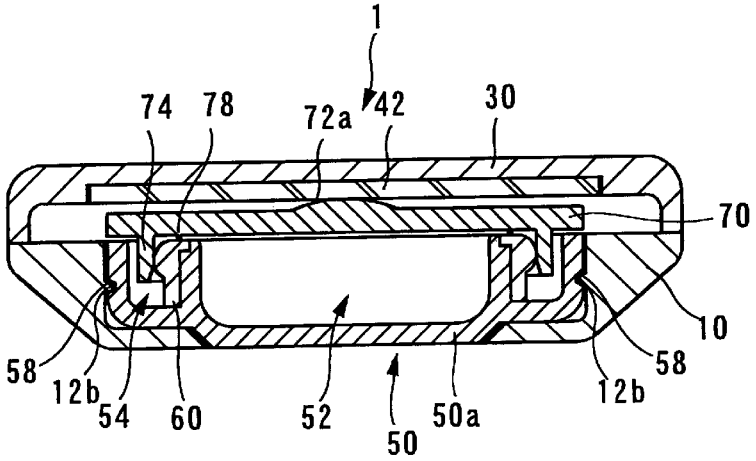
FIG. 14 is a front cross sectional view of the first modified version of the second embodiment.
Figure 15:
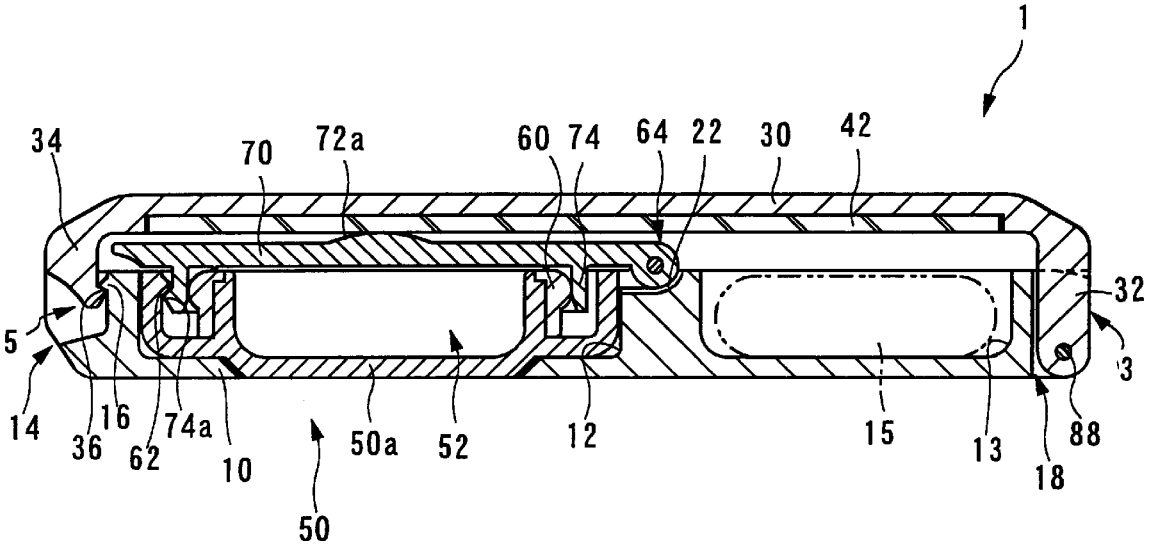
FIG. 15 is a lateral cross sectional view of the first modified version of the second embodiment.
Figure 16:
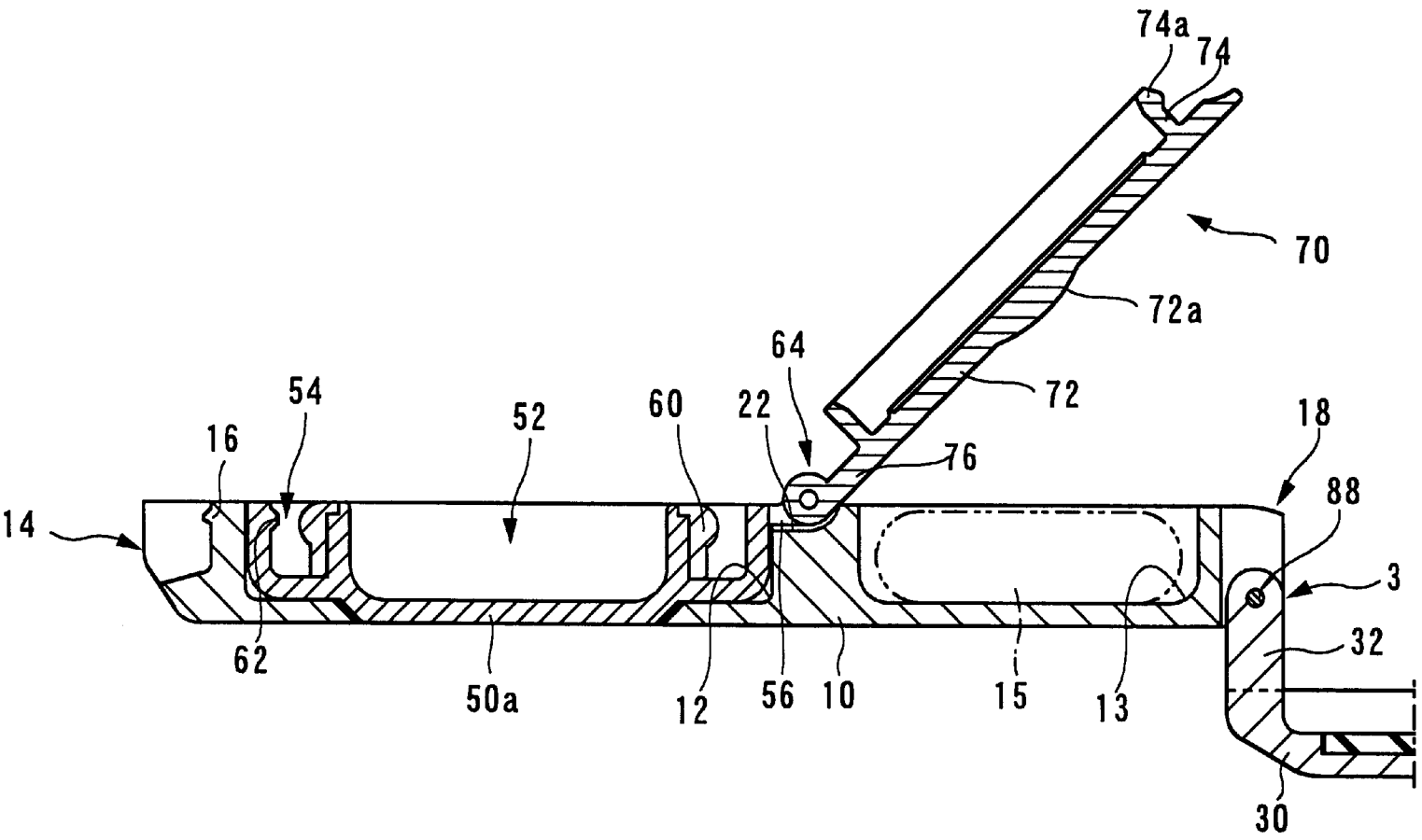
FIG. 16 is a lateral cross sectional view of the first modified version of the second embodiment with the outer and inner covers in an open position.
Figure 17:
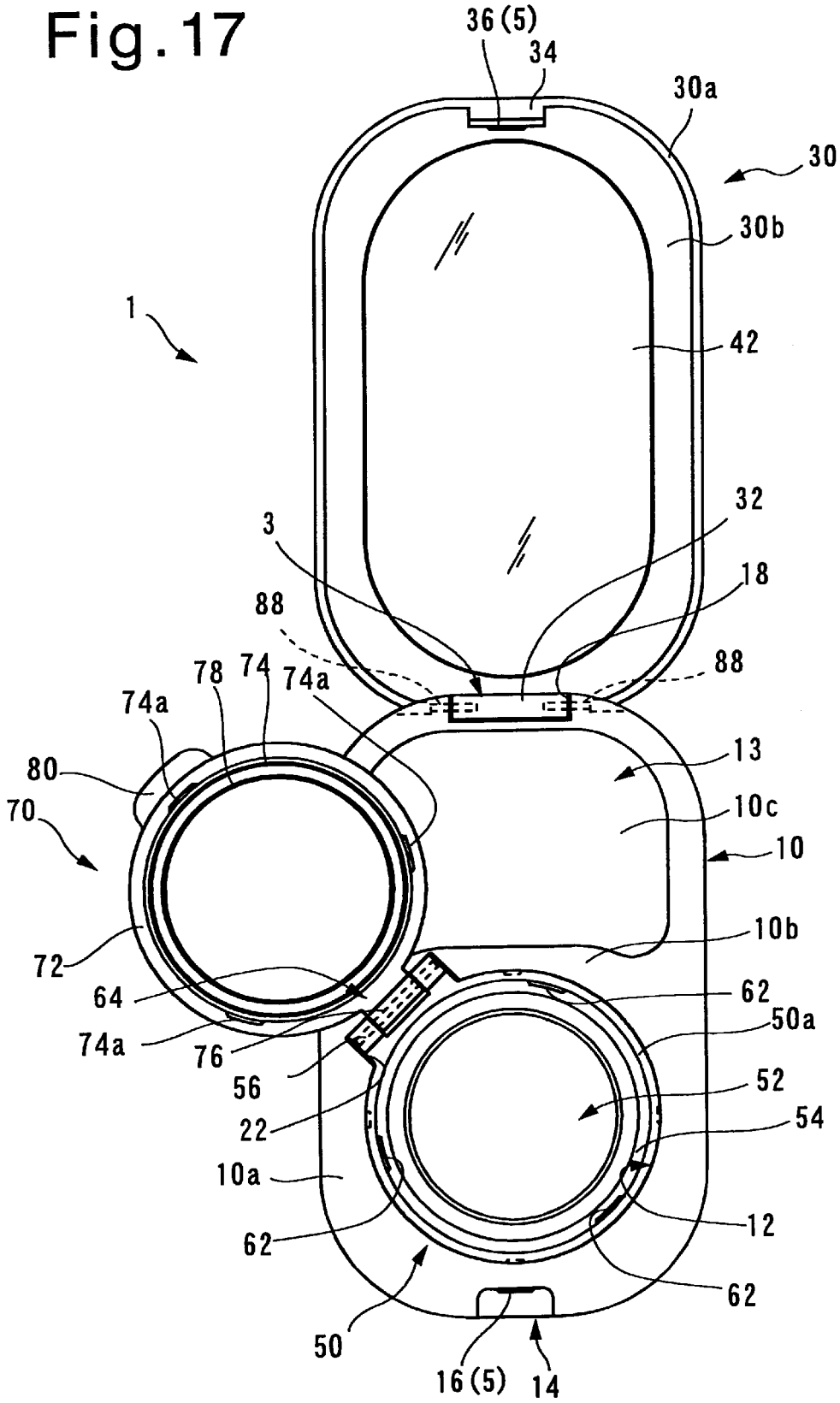
FIG. 17 is a plan view of a second modified version of the second embodiment.
Figure 18:
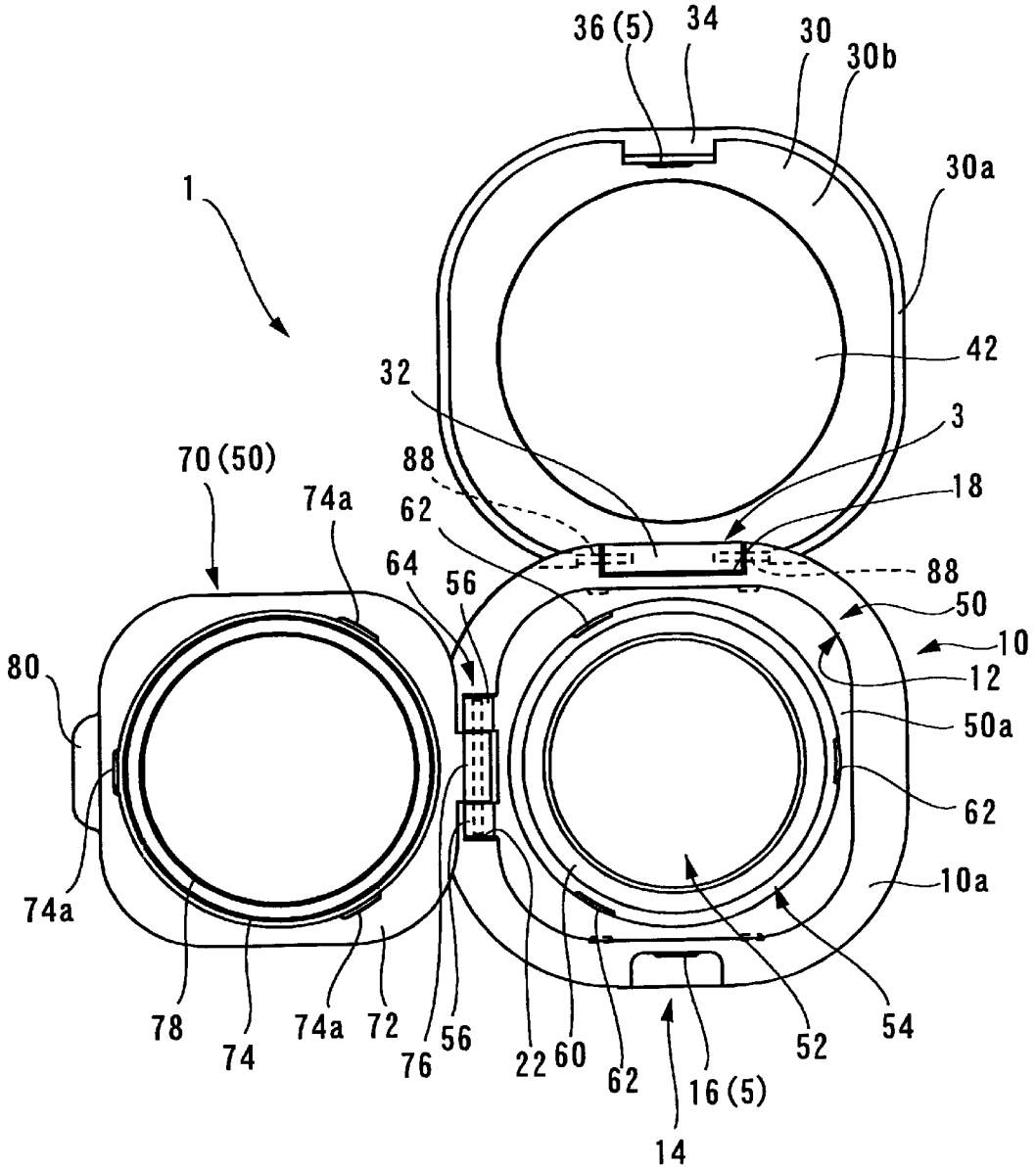
FIG. 18 is a plan view of a third embodiment of the invention with the main case cover and refill container cover in an open position.
Figure 19:
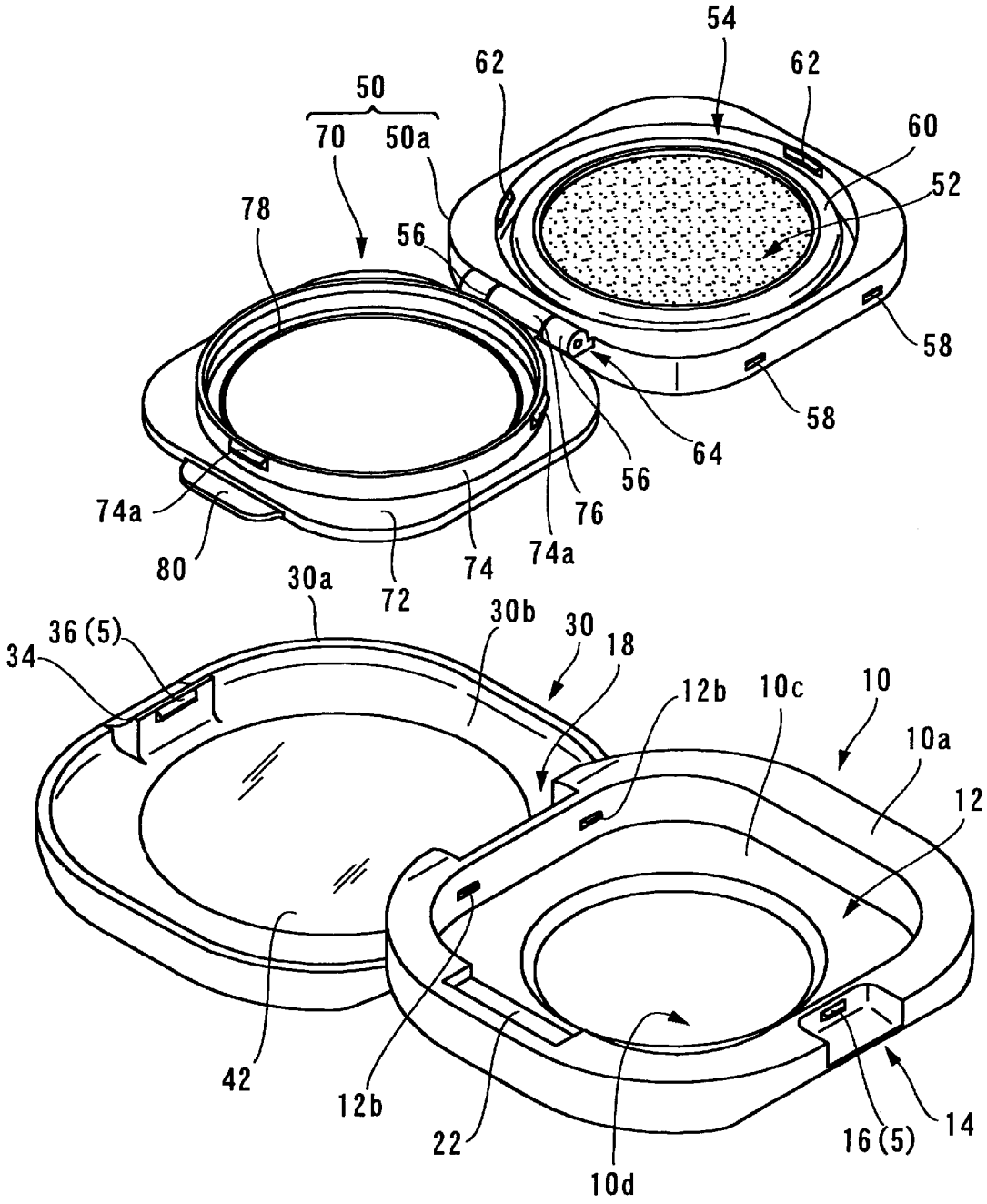
FIG. 19 is an oblique exploded view of the third embodiment.
Figure 20:
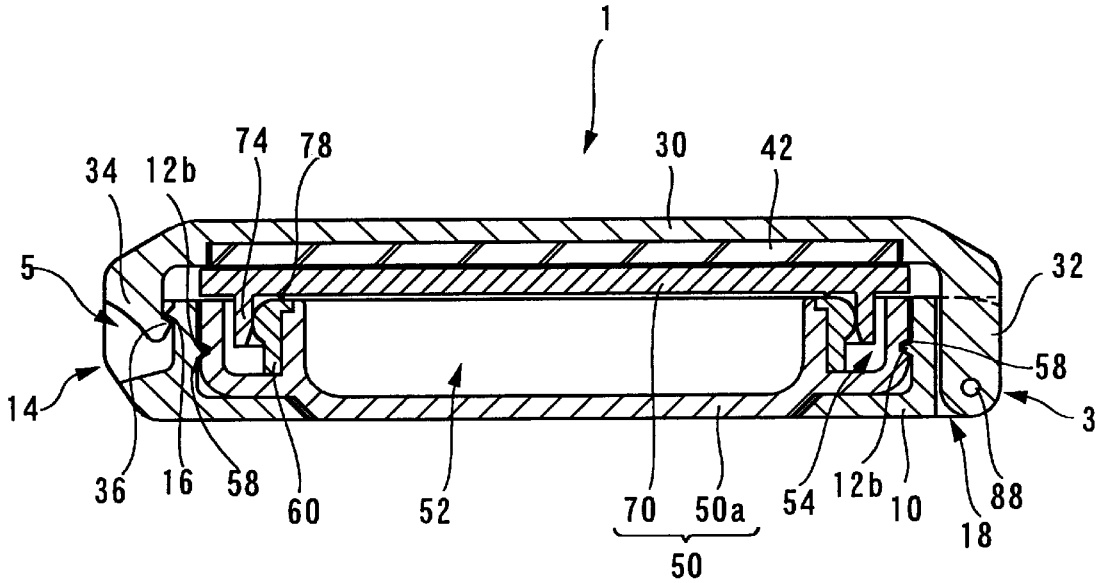
FIG. 20 is a lateral cross sectional view of the third embodiment.
Figure 21:
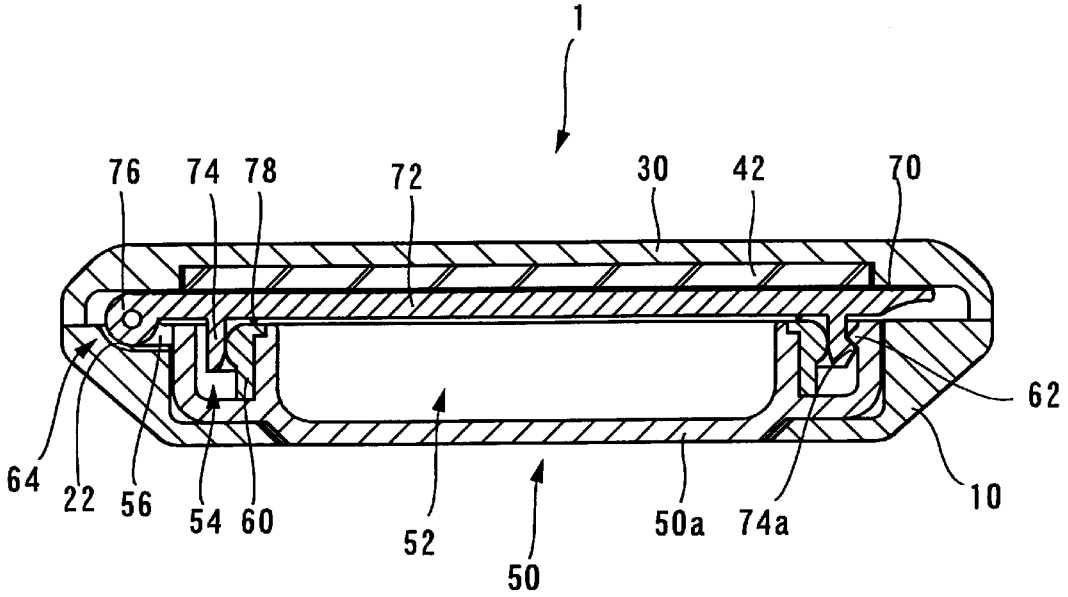
FIG. 21 is a front cross sectional view of the third embodiment.

While the figures show cutout space 22 provided within perimeter wall 10*a* on the left side of compartment 12, in this embodiment cutout space 22 may also be located at any position around the perimeter of compartment 12. As FIGS. 12 and 13 demonstrate, cutout space 22 may be formed within divider wall 10*b* facing compartment 12, and may also be formed, as shown by FIG. 17, at an angular orientation within perimeter wall 10*a* to the left of divider wall 10*b* and compartment 12.

FIGS. 18 through 21 show a third embodiment of the invention wherein main case 10 is formed to an approximate square shape by perimeter wall 10*a* and bottom wall 10*c*, said walls defining only compartment 12 within case 10.

Figure 22:
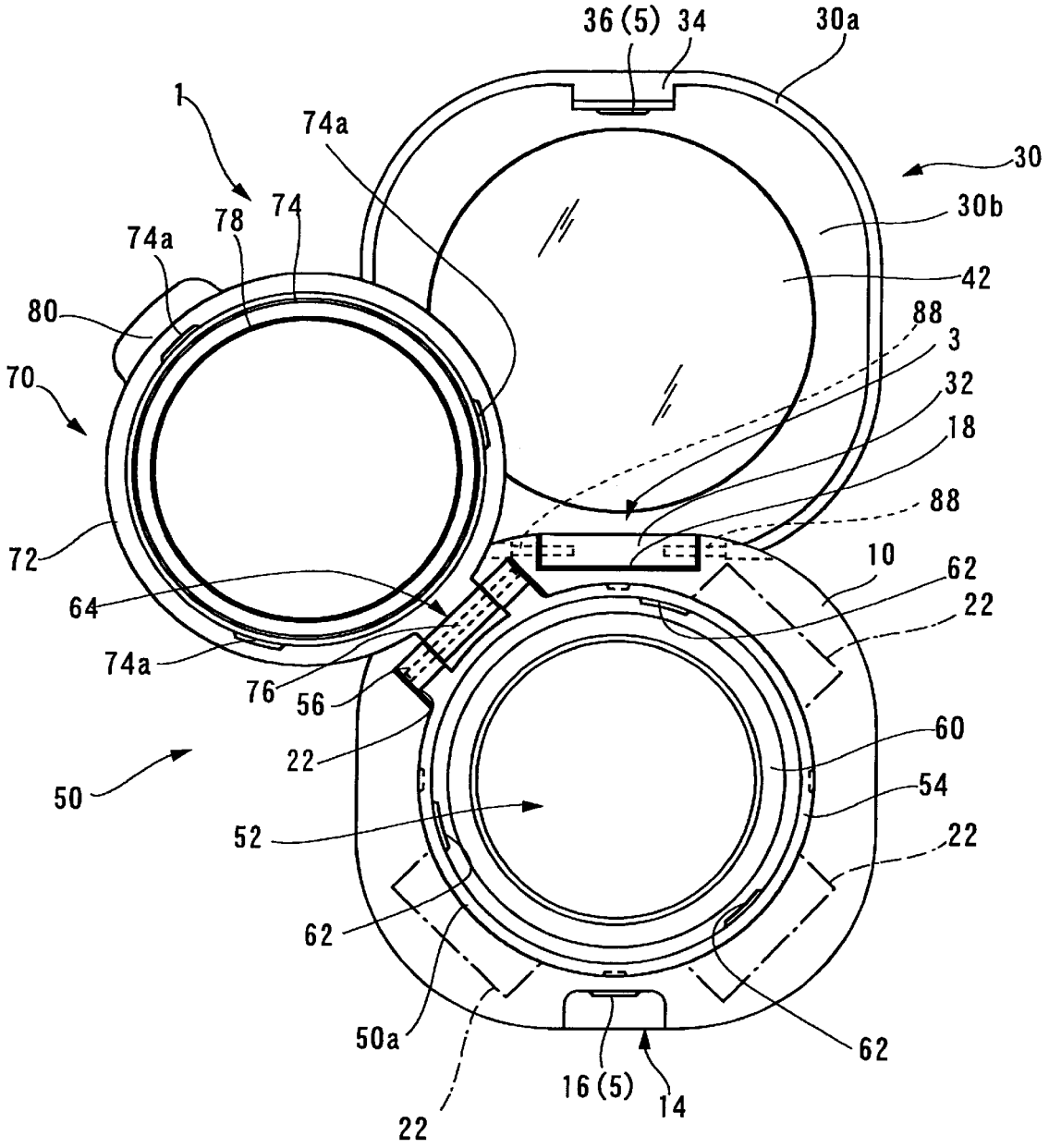
FIG. 22 is a plan view of the third embodiment with the main case cover and refill container cover in an open position.

Cutout space 22 is formed within perimeter wall 10*a* on the left side of compartment 12, and as FIG. 22 demonstrates, container cover 70 may also be angularly positioned so as not to overlap main case cover 30 when container cover 70 is open. In terms of practical design, the most advantageous position of cutout space 22 would lie at a point within a region extending from main latch 5 to case hinge 3.

Figure 23:
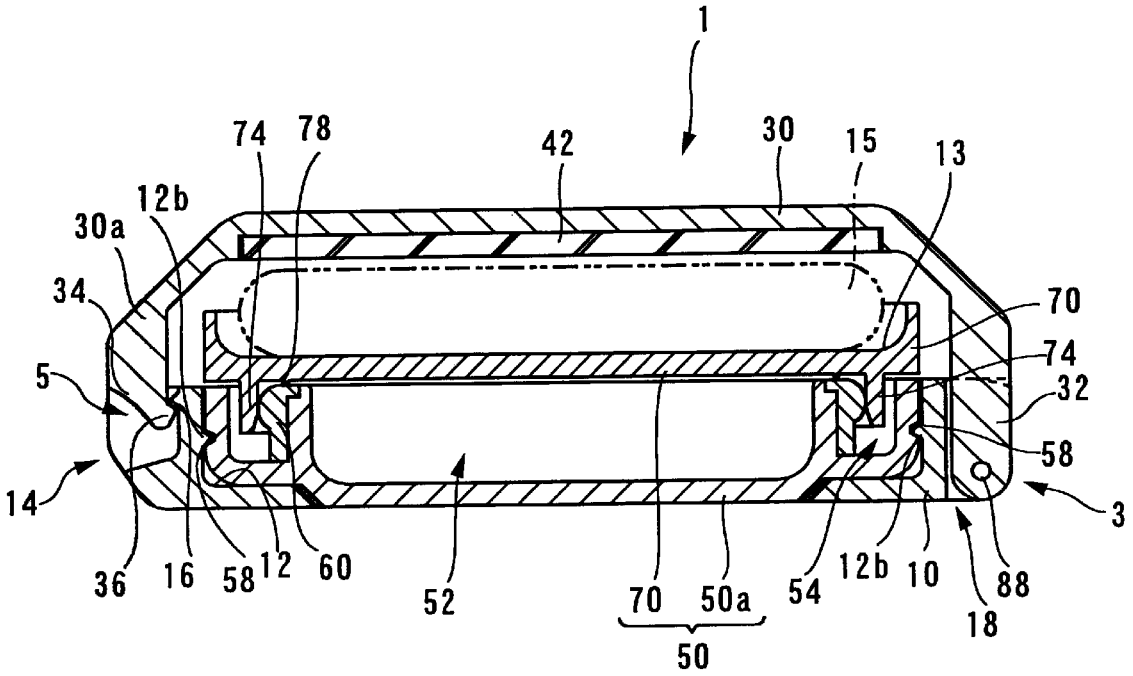
FIG. 23 is a lateral cross sectional view of a modified version of the third embodiment.
Figure 24:
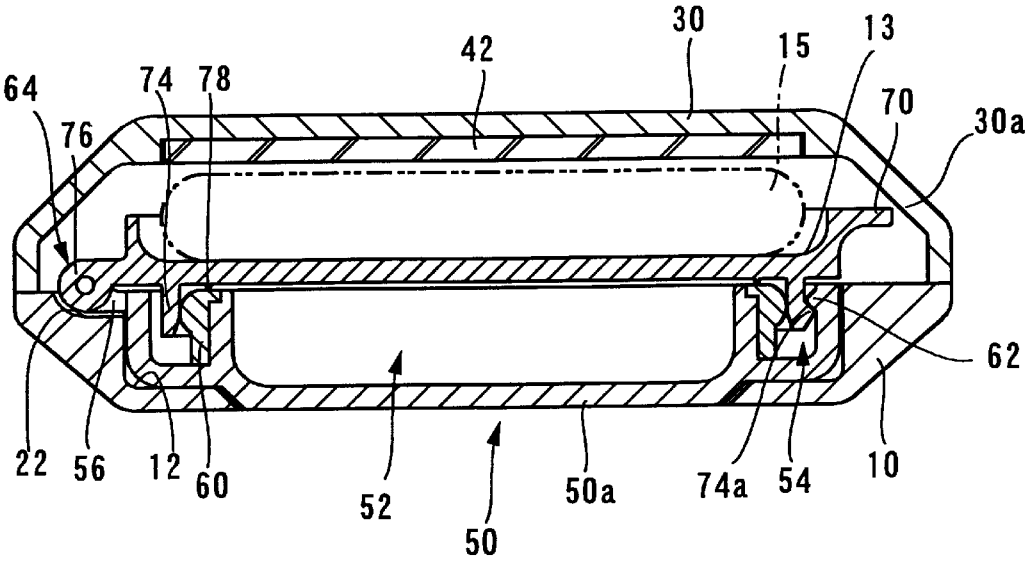
FIG. 24 is a front cross sectional view of the modified version of the third embodiment.

FIGS. 23 through 26 show a modification to the third embodiment wherein, as shown in FIGS. 23 and 24, dish-shaped compartment 13 is integrally formed on the upper surface of container cover 70, and perimeter wall 30*a* of main case cover 30 is formed to a higher dimension. This structure allows for compartment 12 and 13 to be vertically overlapped when the cosmetic case is closed, thus allowing main case 10 to be of the approximate same size as compartment 12 while still permitting the inclusion of cosmetic applicator tool 15, and thus allowing the cosmetic case to be made to more compact dimensions.

Figure 25:
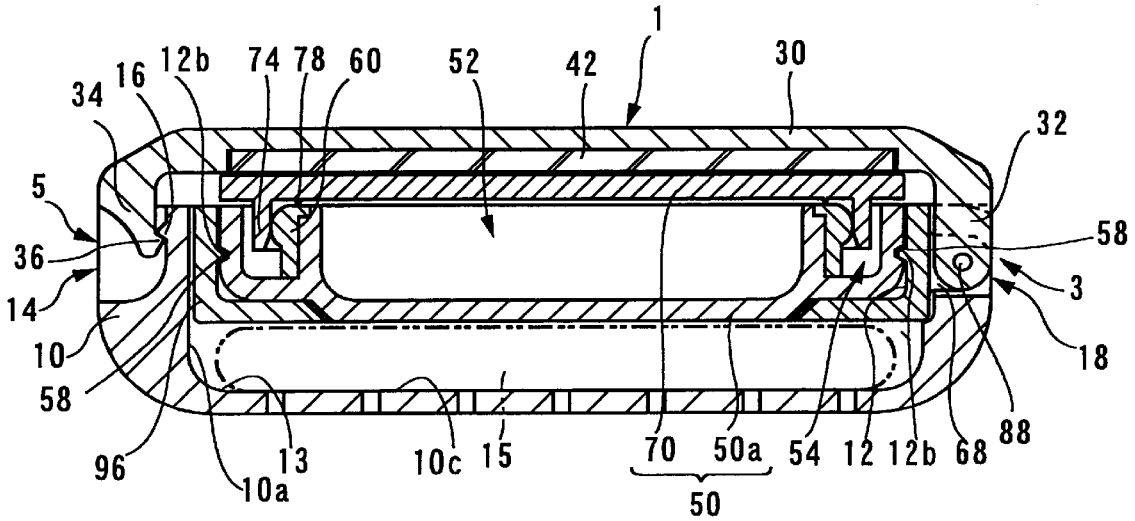
FIG. 25 is a lateral cross sectional view of the modified version of the third embodiment.
Figure 26:
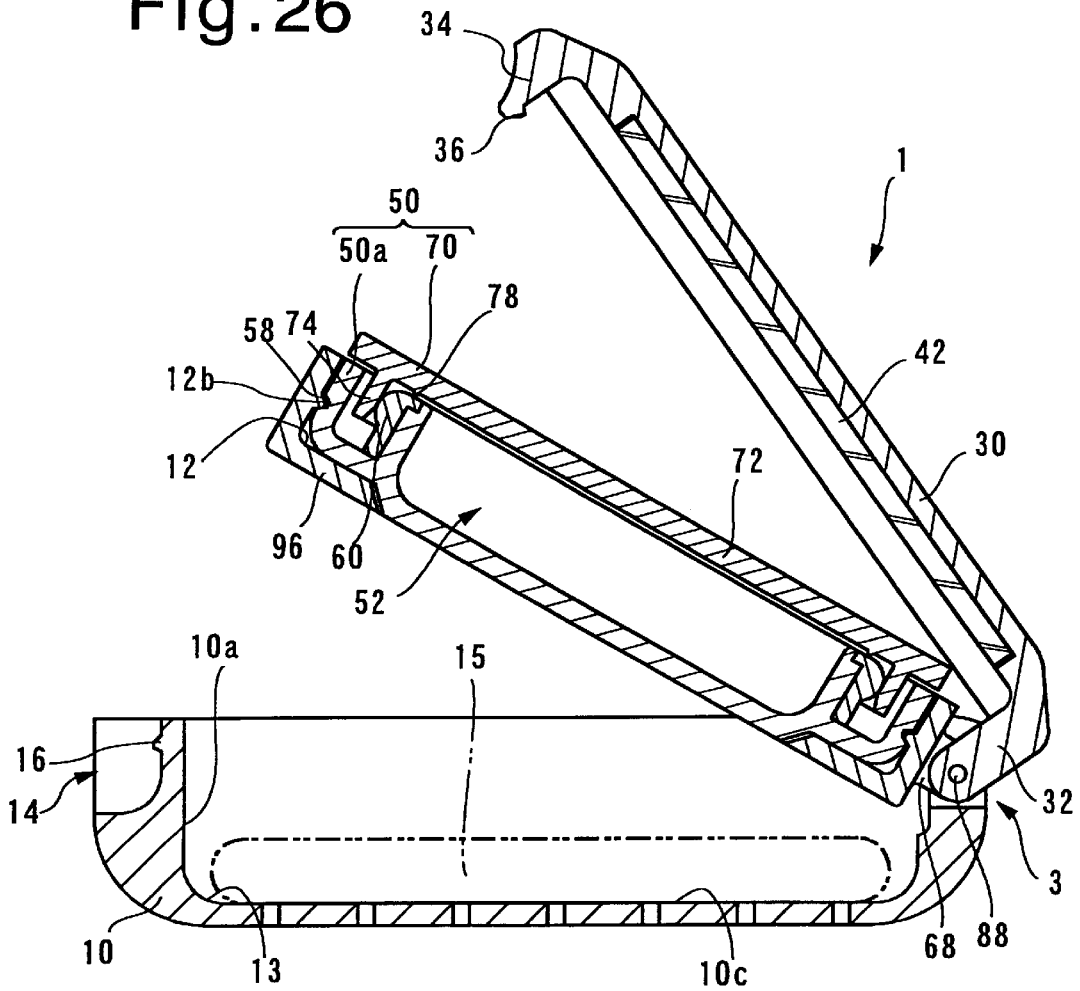
FIG. 26 is a lateral cross sectional view of the modified version of the third embodiment showing the main case cover and mid frame in an opened position.
Figure 27:
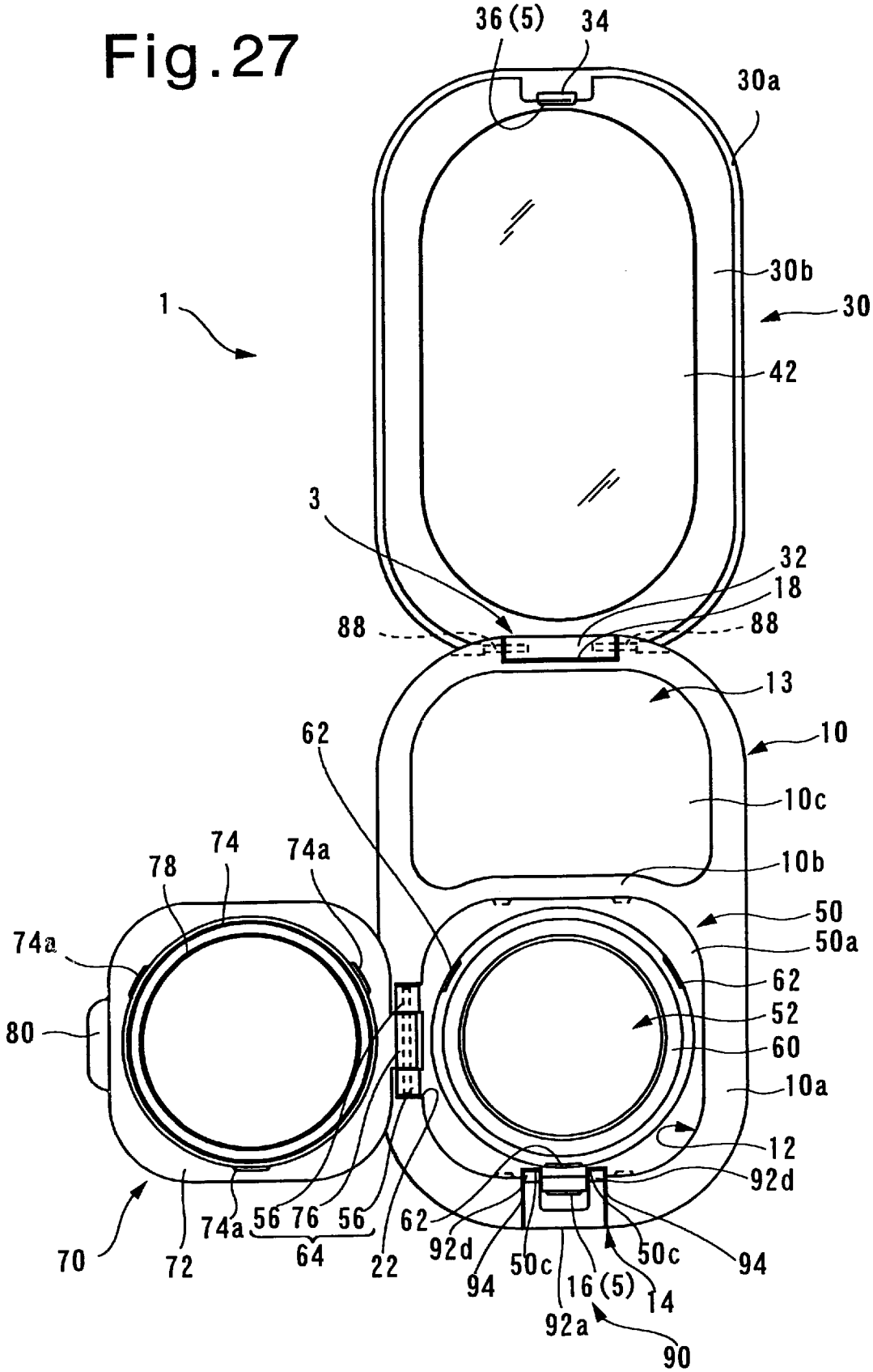
FIG. 27 is a plan view of the fourth embodiment of the invention with the main case cover and refill container cover in an open position.
Figure 28:
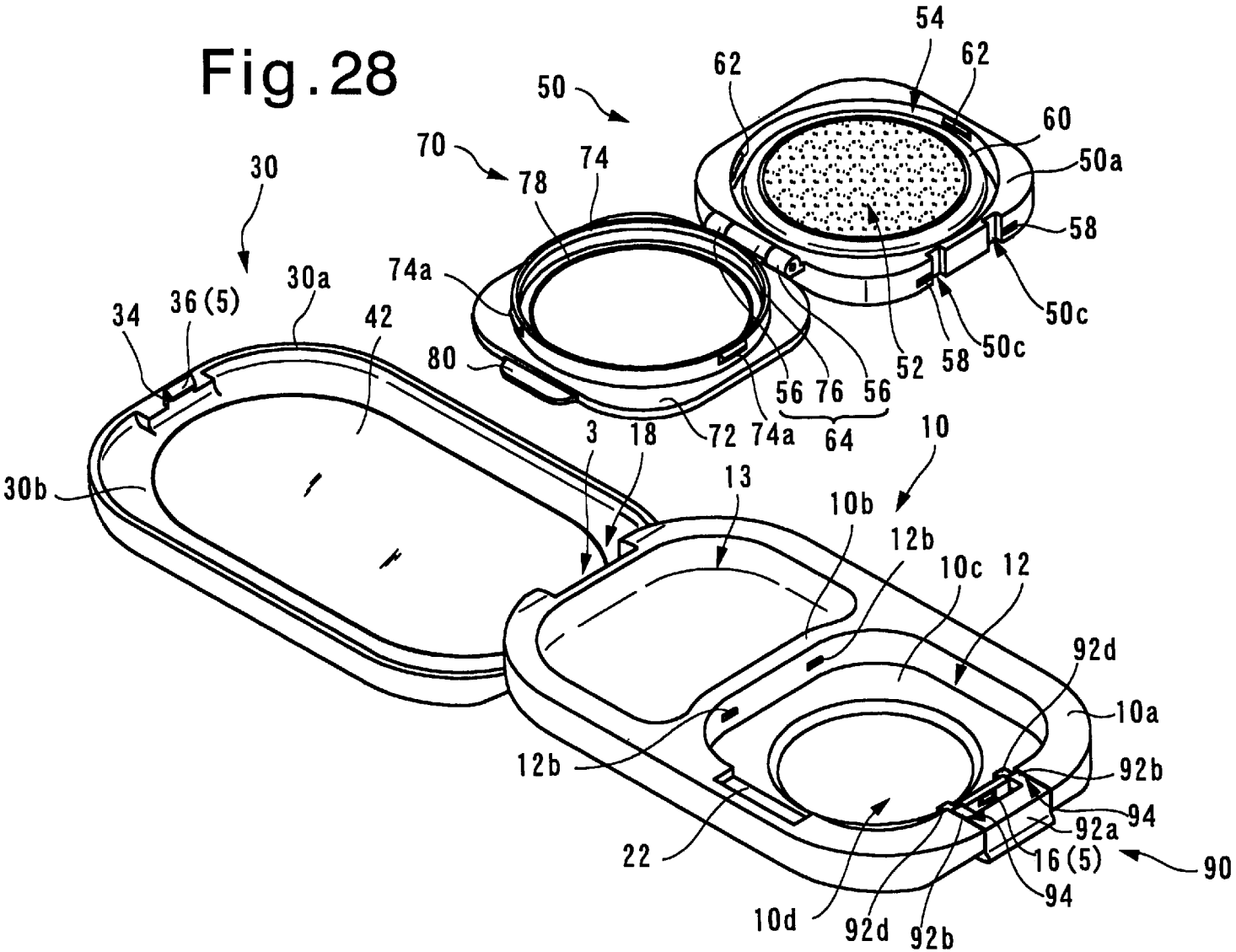
FIG. 28 is an oblique exploded view of the fourth embodiment of the invention.
Figure 29:
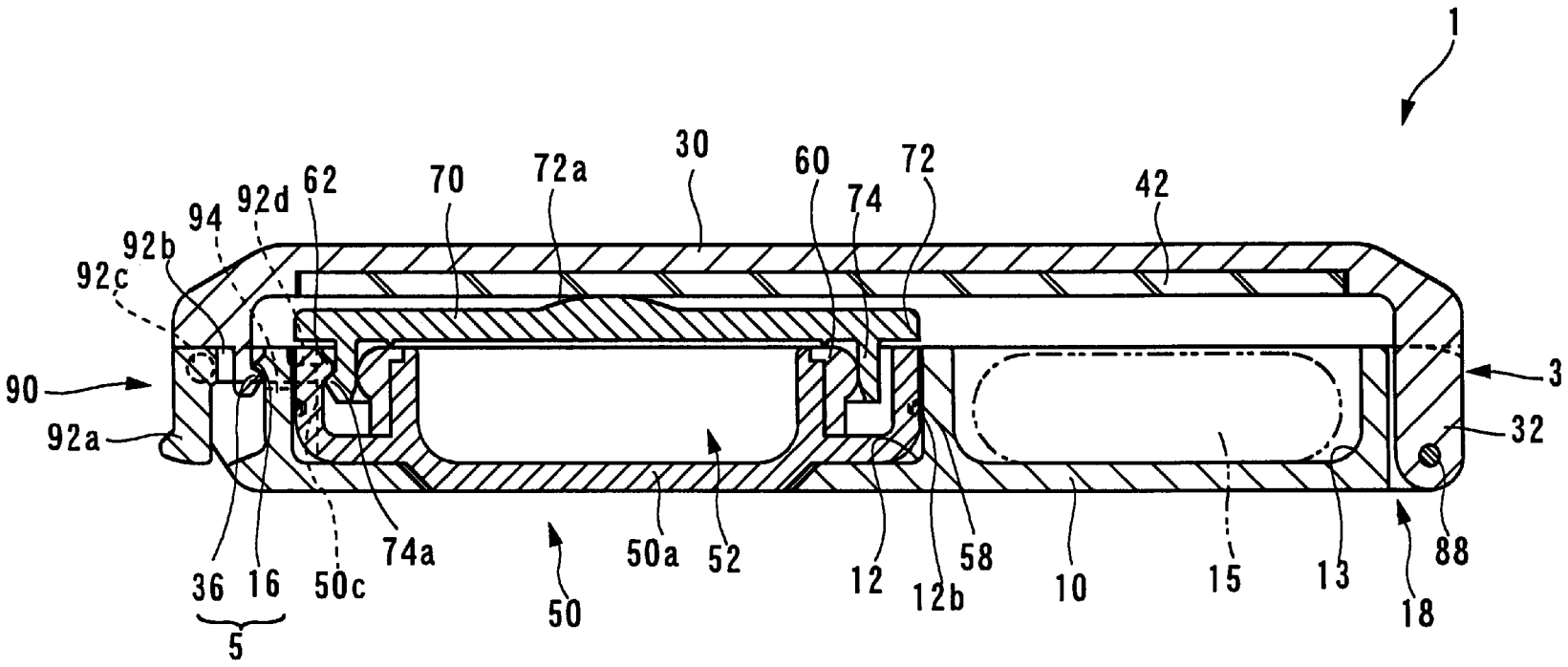
FIG. 29 is a lateral cross sectional view of the fourth embodiment.
Figure 30:
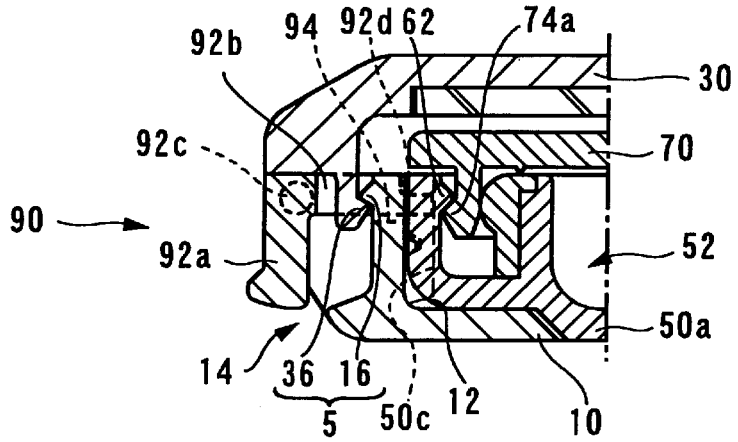
FIG. 30 is a lateral cross sectional view of the latch of the fourth embodiment with the main case cover and refill container cover in an open position.
Figure 31:
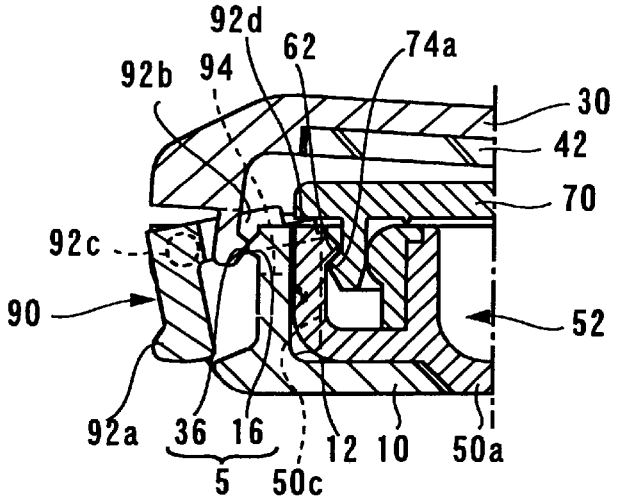
FIG. 31 is a lateral cross sectional view of the latch of the fourth embodiment with the main case cover latch released.
Figure 32:
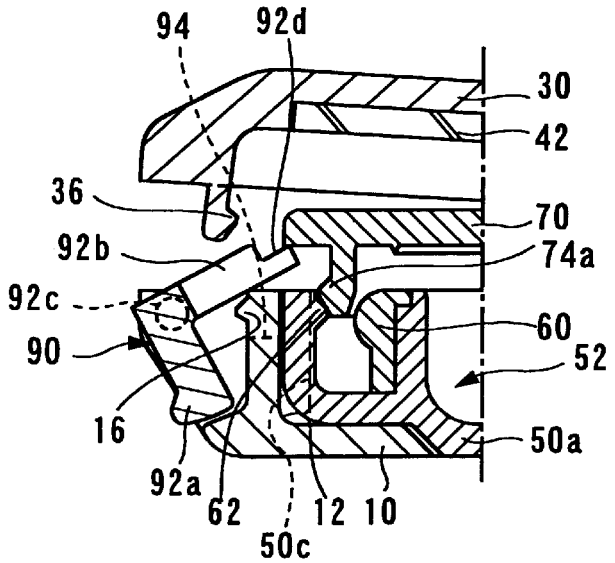
FIG. 32 is a lateral cross sectional view of the latch of the fourth embodiment with the main case cover and refill container cover in an open position.

FIGS. 25 and 26 show a further modification to the third embodiment wherein compartment 13 is located below compartment 12. In this structure, internal frame 96 is used to form compartment 12 within main case 10. Internal frame 96 and main case cover 30 are both attached to main case 10 in a manner as to allow their free rotation therein. Compartment 13 is located directly below internal frame 96 and serves as a storage space for cosmetic applicator tool 15.

As the height of main case 10 and perimeter wall 10*a* are increased, a space is provided below internal frame 96 for use as storage for cosmetic applicator tool 15. Multiple ventilation orifices are provided in bottom wall 10*c*. Pivot boss 68, formed on the rear edge of internal frame 96, is installed, along with hinge boss 32 of main case cover 30, into hinge cutout 18 of main case 10. Hinge pin 88 is inserted through main case hinge boss bosses 32 and pivot boss 68 so as to allow both main case cover 30 and internal frame 96 to freely pivot on the same axis within main case 10.

This structure allows internal frame 96 to be exposed when main case cover 30 is rotated upward, and compartment 13 to be exposed when internal frame 96 is rotated upward, thus allowing cosmetic applicator tool 15 to be removed from the cosmetic case.

FIGS. 27 through 32 depict a fourth embodiment of the invention wherein release latch 90 is provided as means of releasing main latch 5 as well as cover fingers 74*a* and container fingers 62 of refill container 50.

Horizontal release notch 94 is formed within the upper area of perimeter wall 10*a* and extends inward, on both sides of case joint lip 16, to compartment 12. A pair of vertical release notches 50*c* is formed on the edge of refill container body 50*a* at a location opposing release notch 94.

Release latch 90 is a reversed and inverted L-shape piece rotatably supported by pin 92*c* within front latch cutout 14. The front part of latch 90 is comprised of vertically oriented push piece 92*a* which is exposed outwardly at the front of latch cutout 14. The rear part is comprised of horizontally oriented push-up part 92*b* which passes through the lower area of notch 94, under main case cover 30, and extends to vertical release notches 50*c*. Push-up fingers 92*d*, formed on the end of push-up part 92*b*, reside within vertical release notches 50*c* directly beneath container cover 70. Pressure applied against push piece 92*a* will result in release latch 90 rotating on pin 92*c,* thus causing push-up part 92*b* to press upward against both main case cover 30 and container cover 70 with sufficient pressure to release their respective connections.

The mechanism put forth in this fourth embodiment allows both main case cover 30 and container cover 70 to be opened by the same release mechanism, thus improving the operability and convenience of the cosmetic case. Moreover, the sequential opening timing of main case cover 30 and container cover 70 can be adjusted through modification to push-up part 92*b* and push-up fingers 92*d,* a capability which would allow only main case cover 30 to open as means of accessing mirror 42 without opening refill container 50.

What is claimed is:

1. A structure for a cosmetic case comprised of, a main case part enclosing an internal space defined by a perimeter wall, a main case cover part installed by means of a main hinge part located at the rear of said main case part, said main case cover part being capable of a pivoting movement as means of exposing or closing said internal space, a main latch located at the front extremity of said main case part and main case cover part, said main latch being capable of maintaining and releasing a joint between said main case part and main case cover part, a sealable refill container part detachably installed within said internal space, said refill container part being comprised of, (a) a container body part being filled with a cosmetic substance therein, (b) a refill container cover part pivotably connected to one extremity of said container body part by means of a container hinge part in a manner as to seal or expose the inside of said cosmetic body part, and (c) a refill container latch formed at an extremity of said container body part and container cover part, said latch being capable of maintaining or releasing a joint between said container cover part and container body part; and a cutout space provided at a location between said main hinge part and main latch as means of housing said refill container hinge part, said cutout space being formed within the inner surface of said perimeter wall facing said internal space, but not extending to the outer surface of said perimeter wall.

2. A cosmetic case structure as put forth in claim 1 wherein said internal space is formed as an integral component of said main case part, said sealable refill container part being removably installed within said internal space, and said cutout space being formed within said perimeter wall at a location that does not interfere with said main hinge and main latch.

3. A cosmetic case structure as put forth in claim 1 wherein, a divider wall is provided within said internal space so as to separate said space into a front and rear compartment, said refill container part is removably installed within said rear compartment, and said cutout space is formed only in said rear compartment and located at a point that does not interfere with said main hinge within, said point lying within a region extending from said perimeter wall through said divider wall.

4. A cosmetic case structure as put forth in claim 1 wherein, a divider wall is provided within said internal space so as to separate said space into a front and rear compartment, said refill container part is removably installed within said front compartment, and said cutout space is formed only in said front compartment and located at a point that does not interfere with said main latch within, said point lying within a region extending from said perimeter wall through said divider wall.

5. A cosmetic case structure as put forth in claim 1 wherein, a single release part is provided at the front extremity of said main case part as means of opening both said main case cover and container cover by forcibly releasing said main latch and refill container latch, the center section of said release part is pivotably supported by said main case part, one extremity of said release part is provided as a push piece exposed at the external surface of said main case, and the other extremity of said release part is provided as a push-up part located opposite to said push piece, extending rearward from said center section, and being capable of pivotably contacting and pushing up both said main case cover and refill container cover.

6. A cosmetic case structure as put forth in claim 5 wherein, said push-up part incorporates an main case cover push-up part to pushup said main case cover part only, and a refill container cover push-up part to push up said refill container cover only, the dimension between said refill container cover push-up and refill container cover part being established as a longer dimension than that between said main case cover push-up part and main case cover part, thus providing an operating motion in which said main case cover part opens before said container cover part.

7. A cosmetic case structure as put forth in claim 1 wherein, a cosmetic applicator tool storage space is provided above said refill container cover and enclosed by said main case cover.

8. A cosmetic case as put forth in claim 1 wherein, an internal frame part is connected to said main hinge part so as to be rotatably installed within said internal space, said refill container part is removably installed within said internal frame part, and said cosmetic applicator tool storage space is formed under said internal frame part in a space enclosed by said main case part.

* * * * *